US010235833B2

(12) United States Patent
Callaway

(10) Patent No.: US 10,235,833 B2
(45) Date of Patent: Mar. 19, 2019

(54) SYSTEM FOR AUTOMATING THE DETECTION OF PROBLEM GAMBLING BEHAVIOUR AND THE INHIBITION AND CONTROL OF GAMING MACHINE AND GAMBLING DEVICE FUNCTIONALITY

(71) Applicant: T. CALLAWAY AND ASSOCIATES PTY LTD, Bonnet Bay (AU)

(72) Inventor: Trevor Callaway, Bonnet Bay (AU)

(73) Assignee: T. CALLAWAY AND ASSOCIATES PTY LTD, Bonnet Bay (AU)

( * ) Notice: Subject to any disclaimer, the term of this patent is extended or adjusted under 35 U.S.C. 154(b) by 824 days.

(21) Appl. No.: 14/401,651

(22) PCT Filed: May 17, 2013

(86) PCT No.: PCT/AU2013/000523
§ 371 (c)(1),
(2) Date: Nov. 17, 2014

(87) PCT Pub. No.: WO2013/170318
PCT Pub. Date: Nov. 21, 2013

(65) Prior Publication Data

US 2015/0141123 A1 May 21, 2015

(30) Foreign Application Priority Data

May 17, 2012 (AU) ..... 2012902024

(51) Int. Cl.
*G07F 17/00* (2006.01)
*G07F 19/00* (2006.01)
*G07F 17/32* (2006.01)

(52) U.S. Cl.
CPC ..... *G07F 17/3237* (2013.01); *G07F 17/3206* (2013.01); *G07F 17/3209* (2013.01);
(Continued)

(58) Field of Classification Search
CPC ..... G07F 17/3206; G07F 17/3209; G07F 17/3218; G07F 17/3225; G07F 17/3227;
(Continued)

(56) References Cited

U.S. PATENT DOCUMENTS 6,142,876 A * 11/2000 Cumbers ..... G06K 9/00597 235/380
6,612,928 B1 * 9/2003 Bradford ..... G06F 21/31 463/29

(Continued)

FOREIGN PATENT DOCUMENTS

WO 2005098650 A1 10/2005

OTHER PUBLICATIONS

Caudill, Maureen. "A Basic Introduction to Neural Networks". Dated 1989. [online], [retrieved on Dec. 14, 2017]. <URL:http://pages.wisc.edu/~bolo/shipyard/neural/local.html>. 5 Pages.*

(Continued)

*Primary Examiner* — Milap Shah
(74) *Attorney, Agent, or Firm* — Innovation Capital Law Group, LLP; Vic Lin

(57) ABSTRACT

There is provide a system for automating the detecting of problem gambling behavior, the system [200] comprising at least one of a player interface [105] adapted for receiving biometric data from a player; and in-game data source [135] adapted for generating in-game data, wherein, in use the system [200] is adapted for detecting problem gambling behavior in accordance with at least one of the one of the biometric data and the in-game data.

13 Claims, 6 Drawing Sheets

(52) U.S. Cl.
CPC ..... *G07F 17/3218* (2013.01); *G07F 17/3225* (2013.01); *G07F 17/3239* (2013.01); *G07F 17/3241* (2013.01)

(58) Field of Classification Search
CPC ..... G07F 17/3232; G07F 17/3234; G07F 17/3237; G07F 17/3239; G07F 17/3241
See application file for complete search history.

(56) References Cited

U.S. PATENT DOCUMENTS

2001/0031663 A1* 10/2001 Johnson ..... G06Q 50/34 463/42
2002/0138461 A1* 9/2002 Sinclair ..... G06Q 40/02
2003/0190944 A1* 10/2003 Manfredi ..... G07F 17/32 463/20
2004/0121841 A1* 6/2004 Xidos ..... G07F 17/32 463/40
2004/0147313 A1* 7/2004 Stanley ..... G07F 17/32 463/29
2006/0205489 A1 9/2006 Carpenter et al.
2006/0211493 A1* 9/2006 Walker ..... G06Q 30/02 463/29
2006/0287068 A1 12/2006 Walker et al.
2008/0090645 A1* 4/2008 Walker ..... G07F 17/3237 463/25
2008/0199838 A1* 8/2008 Flanagan ..... G07F 7/0866 434/236
2009/0082082 A1* 3/2009 Carr-Gregg ..... G07F 17/32 463/20
2009/0124376 A1* 5/2009 Kelly ..... G07F 17/3206 463/29
2009/0176566 A1* 7/2009 Kelly ..... G07F 17/32 463/29
2010/0062834 A1* 3/2010 Ryan ..... G07F 17/32 463/25
2011/0077073 A1* 3/2011 Gagner ..... G06Q 20/405 463/25
2011/0128382 A1* 6/2011 Pennington ..... G07F 17/32 348/153
2012/0021832 A1* 1/2012 Lyons ..... G07F 17/3206 463/36
2012/0258795 A1* 10/2012 Ryan ..... G07F 17/3206 463/29

OTHER PUBLICATIONS

Allock, et al. "Current Issues Related to Identifying the Problem Gambler in the Gambling Venue". Aug. 2002. 45 Pages.*
Chan, V. K. Y. Using neural networks to model the behavior and decisions of gamblers, in particular, cybergamblers. Journal of Gambling Studies, 26(1), pp. 35-52. [Published Online Nov. 7, 2009].*
Gobet, Fernand & Schiller, Marvin. (2011). A Manifesto for Cognitive Models of Problem Gambling. European Perspectives on Cognitive Science. 6 Pages.*
Anonymous: "Artificial neural network—Wikipedia", May 5, 2012 (May 5, 2012), XP055389109, Wikipedia Retrieved from the Internet: URL:https://en.wikipedia.org/w/index.php?title=Artificial_neural_network&oldid=490752715 [retrieved on Jul. 7, 2017].
International Search Report (dated Jul. 15, 2013) for PCT/AU2013/0000523, filed May 17, 2013.
International Preliminary Report on Patentability (dated Sep. 11, 2014) for PCT/AU2013/0000523, filed May 17, 2013.

* cited by examiner

SYSTEM FOR AUTOMATING THE DETECTION OF PROBLEM GAMBLING BEHAVIOUR AND THE INHIBITION AND CONTROL OF GAMING MACHINE AND GAMBLING DEVICE FUNCTIONALITY

FIELD OF THE INVENTION

The present invention relates to a system for automating the detection of problem gambling behavior including as is applicable to the detection and control of problem gambling on electronic gaming machines, online gambling systems, gambling using mobile communication devices, gaming tables and the like.

BACKGROUND

Electronic gambling machines, also known as poker machines and the like, are a popular form of gambling in many countries throughout the world. Therefore, the background details will focus on gambling issues as they relate to electronic gambling machines. The other forms of gambling, whilst important in terms of social issues when compared to gambling on electronic gambling machines, are relatively minor compared with issues regarding electronic gambling machines.

In most countries surveyed throughout the world, problem gambling involving electronic gambling machines has become a major social issue with financial harm being suffered by a significant proportion of gamblers and their families. The problem has been intensely studied in Australia where expenditure on electronic gambling machines comprises around 62% of all gambling. In the Australian Productivity Commission's report of 2010 it was estimated that one in six people who play poker machines regularly are problem gamblers, at various levels of addictiveness, and account for 40% of gambling machine revenue. Furthermore, problem gambling is difficult to recognise with only 15% of problem gamblers seeking counseling and support for their problems. Many can go on for years hiding their gambling problem from others. The primary focus of proposed regulatory controls and of this invention is the pathologically addictive gambler who accounts for an estimated 1.5% of all electronic gambling machine players, however, this invention will have the capability to identify various levels of less addictive gamblers.

Regulators and others across the world have implemented many policies aimed at minimizing the losses from problem gamblers playing on electronic gambling machines. Most of these policies impose restrictions on all gamblers even though for most gambling is an enjoyable pursuit without harm. Typically, these restrictions may involve periods of machine shutdown, maximum betting limits, ATM (Automatic Teller Machine) withdrawal limits, payout limits, reduced input levels, clocks on machines, voluntary and mandatory pre-commitment systems, voluntary and mandatory restriction on access to venues, and so on. Many of these systems have very high implementation and administration costs with little benefit to non problem gamblers.

Other complex and comprehensive systems have been proposed that involve mandatory biometric identification devices, networking of electronic gambling machines, mandatory registration of gamblers, centralized storage on remote servers of gambler profiles including their gambling records, playing restrictions, etc.

These systems can only be effective once a problem gambler has been somehow identified, reported by a third party, or has self reported. Unfortunately, as mentioned before, very few problem gamblers seek support for their problem and less than 15% of pathological gamblers recognise and accept that they have a gambling or addictive problem.

It is to be understood that, if any prior art information is referred to herein; such reference does not constitute an admission that the information forms part of the common general knowledge in the art, in Australia or any other country.

SUMMARY

As such, a need therefore exists for a system for detecting problem gambling behavior for automatically assessing and discerning problem gamblers as they play on electronic gambling machines or the like and for the control the level of gambling involvement of those that have been automatically identified as being additive or problem gamblers.

According to one aspect, there is provided a system for automating the detecting of problem gambling behavior, the system comprising at least one of a player interface adapted for receiving biometric data from a player; and in-game data source adapted for generating in-game data, wherein, in use the system is adapted for detecting problem gambling behavior in accordance with at least one of the biometric data and the in-game data.

Preferably, the biometric data comprises at least one of electrocardiograph data representing a heart rate of the player; conductivity data representing skin conductivity of the player; pressure data representing pressure exerted by the player on the player interface (so as to, for example, ascertain timing interval of play) and image data representing at least one of facial expressions and gestures of the player.

Preferably, the in-game data comprises at least one of game play outcomes; number of credits selected; number of accumulated credits; displayed electronic gambling machine symbols; payouts per selected game play outcomes; total payouts, gameplay interval timing; and total losses.

Preferably, the system is further adapted to receive identification data from the identification device identifying the player.

Preferably, the identification device comprises at least one of a facial image capture device adapted for capturing facial image data; an iris image capture device adapted for generating iris image data; a fingerprint reader device adapted for generating fingerprint data; and a memory device adapted for storing the identification data.

Preferably, the system is further adapted to receive authentication data from the security device authenticating the player.

Preferably, the system is further adapted for storing, using the security device, player profile data representing a profile of the player.

Preferably, the security device is portable.

Preferably, the security device is a smartcard.

Preferably, responsive to the system detecting problem gambling behavior, the system is further adapted to implement gambling limitations.

Preferably, the gambling limitations comprise at least one of maximum wager amount, including per period and per wager; gambling period restriction; and gambling duration restriction limitations.

Preferably, the system is adapted to identify the problem gambling behavior in accordance with an artificial intelligence computation technique.

Preferably, the artificial intelligence competition technique utilizes discrimination data set data, trained using at least biometric data obtained (i.e. experimental data) from known problem gamblers to discriminate between problem gambling behavior and a non-problem gambling behavior.

Preferably, the artificial intelligence competition technique comprises a neural network computation technique.

Preferably, the neural network comprises a single layer of hidden neurons.

Preferably, the player interface comprises a handheld device.

Preferably, the handheld device comprises at least one game play controller.

Preferably, the handheld device comprises at least one biometric sensor.

Preferably, the at least one biometric sensor comprises a heart rate monitor; a skin conductivity sensor; and a pressure gauge.

Preferably, the player interface further comprises a gambling machine interface adapted for transmitting the biometric data from the biometric sensor to a gambling machine in use.

Preferably, the gambling machine interface is a wired interface.

Preferably, the player interface comprises a wristband.

Preferably, the player interface further comprises a gambling machine interface adapted for transmitting the biometric data to a gambling machine in use.

Preferably, the gambling machine interface is a wireless interface.

Preferably, the player interface comprises a computer interface.

Preferably, the computer interface is adapted for interfacing with a computer comprising at least one of personal computer and mobile communication computer.

Preferably, the personal computer interface is a USB interface.

Preferably, the player interface is adapted for disabling a user interface of a computer.

Preferably, the player interface is adapted for authorizing the use of a computer.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

DESCRIPTION OF EMBODIMENTS

Figure 1:
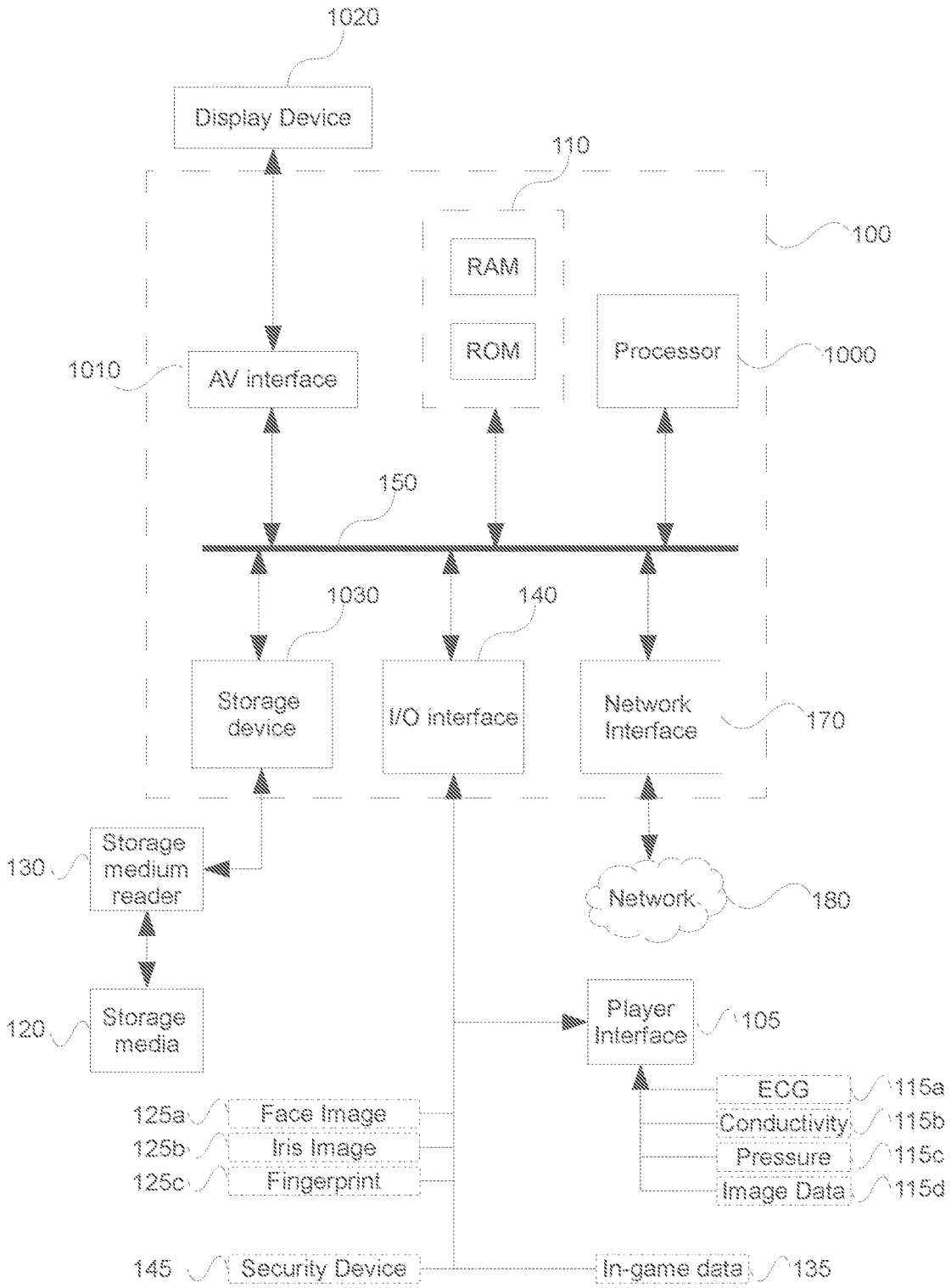
FIG. 1 shows a computing device and player interface on which the various embodiments described herein may be implemented in accordance with an embodiment of the present invention.

It should be noted in the following description that like or the same reference numerals in different embodiments denote the same or similar features.

There is described herein a system, computing device, computer readable storage medium and player interface adapted for the automated detection of pathological gamblers and persons with various stages of addictive behavior for gambling when playing or interfacing with and gambling on various forms of gaming or gambling devices.

These devices include electronic gambling machines, on line gambling using a personal computing devices or the like, online gambling using mobile communication devices (smart phones) and the like, gambling using casino table games, horse and dog racing betting systems and gambling using wagering terminals. Of course, it should be noted that the embodiments as described herein have application over and above those applications specifically enumerated herein.

For those players having been classified as exhibiting problem gambling behavior, the appropriate electronic gaming machine (poker machines and the like) may be controlled for the purposes of limiting the players' gambling behavior, such as by setting wager limits, gambling strategies, gambling time restrictions, gambling time period restrictions and the like.

As will be described in further detail below, in a preferred embodiment, artificial intelligence/machine learning techniques and the like are adapted for the purposes of identifying problem gambling behavior in accordance with a plurality of inputs relating to the player, including biometric data relating to the player, identification data identifying the player and in-game statistical data representing aspects of a game played by the player. More specifically, there is described the use of neural networks and variants of neural networks, drawn from the field of "Supervised Machine Learning", for the diagnosis of persons with addictive behavior as it relates to gambling on electronic gambling machines, the system and methods incorporating the hardware and software.

Computing Device 100 and Player Interface 105

FIG. 1 shows a computing device 100 and player interface 105 on which the various embodiments described herein may be implemented.

As will be described in further detail below, the player interface 105 is adapted for reading, and substantial real-time, biometric data from a player during gambling game play. In this manner, the biometric data measured by the player interface 105 is used by the computing device 100 in automating the detection of problem gambling behavior.

As will also be described in further detail below, the determination of problem gambling behavior may be performed using machine learning techniques having as input appropriate experimental data sets so as to increase accuracy in the detection of problem gambling. Once problem gambling has been identified during game play, appropriate safeguards may be employed which are also be described in further detail below such as limiting game play, notifying authorities and the like.

Referring to FIG. 1, there is described a computing device 100 for identifying problem gambling behavior. Coupled to the computing device is a player interface 105 adapted for sending the biometric data to the computing device 100.

Figure 6:
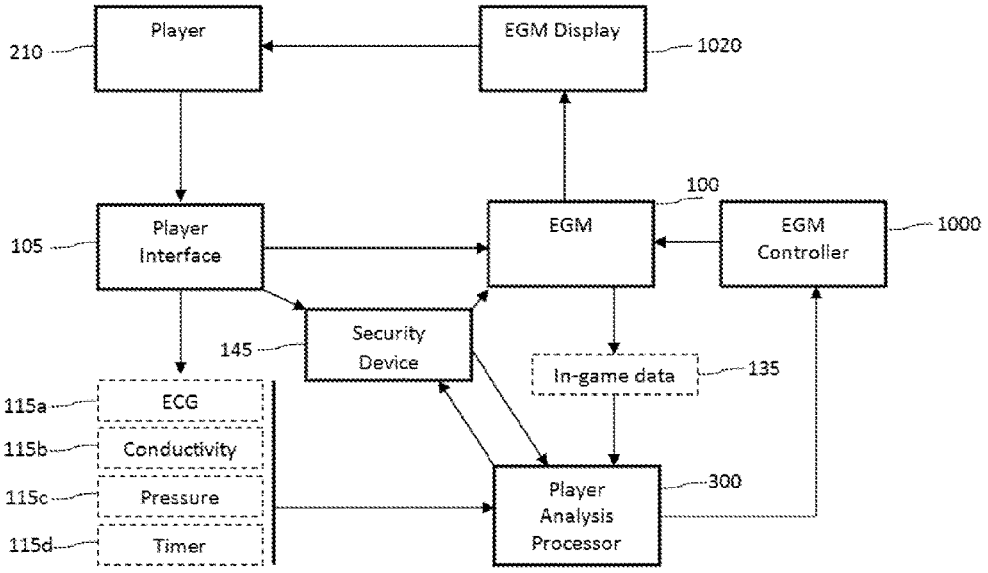
FIG. 6 shows the Game Play synchronization feedback arrangements on various embodiments described herein may be implemented in accordance with an embodiment of the present invention.

As will become apparent from the description below, the player interface 105 is preferably a handheld device, such as a joystick or the like allowing the player to interact with the gaming machine (computer 100), adapted for reading various biometric variables of the player (as illustrated at FIG. 6). The player interface 105 may take on differing technical embodiments also some of which are described below.

It should be noted that the player interface 105 may be implemented in two manners. If this manner is that as substantially shown in FIG. 1, where the player interface 105 communicates with the computing device 100 using I/O interface 140. In this manner, the I/O interface 140 may be an analogue to digital or Digital interface 140 adapted for receiving various biometric variables from the player interface 105. However, in other embodiments, the player interface 105 may itself comprise processing and memory capabilities such that the player interface 105 comprises the additional computing technical integers as shown in FIG. 1, so as to be adapted for communication with a further computing device 100 which further computing device 100 may implement the gaming functionality.

Describing now primarily the computing device 100, the steps of identifying problem gambling behavior may be implemented as computer program code instructions executable by the computing device 100. The computer program code instructions may be divided into one or more computer program code instruction libraries, such as dynamic link libraries (DLL), wherein each of the libraries performs a one or more steps of the method. Additionally, a subset of the one or more of the libraries may perform graphical user interface tasks relating to the steps of the method.

The device 100 comprises semiconductor memory 110 comprising volatile memory such as random access memory (RAM) or read only memory (ROM). The memory 100 may comprise either RAM or ROM or a combination of RAM and ROM and may include a Supervised Machine Learning Device (using neural networks and distributed processing) [SMLD].

The device 100 comprises a computer program code storage medium reader 130 for reading the computer program code instructions from computer program code storage media 120. The storage media 120 may be optical media such as CD-ROM disks, magnetic media such as floppy disks and tape cassettes or flash media such as USB memory sticks.

The device 100 may further comprise further comprises I/O interface 140 for communicating with one or more peripheral devices including the player interface 105. The I/O interface 140 may offer both serial and parallel interface connectivity. Of course, the I/O interface 140 may also communicate with one or more human input devices (HID) such as keyboards, pointing devices, joysticks, audio devices and the like.

The device 100 also comprises a network interface 170 for communicating with one or more computer networks 180. The network 180 may be a wired network, such as a wired Ethernet™ network or a wireless network, such as a Bluetooth™ network or IEEE 802.11 network. The network 180 may be a local area network (LAN), such as a home or office computer network, or a wide area network (WAN), such as the Internet or private WAN.

The device 100 comprises an arithmetic logic unit or processor 1000 for performing the computer program code instructions. The processor 1000 may be a reduced instruction set computer (RISC) or complex instruction set computer (CISC) processor or the like. The device 100 further comprises a storage device 1030, such as a magnetic disk hard drive or a solid state disk drive.

Computer program code instructions may be loaded into the storage device 1030 from the storage media 120 using the storage medium reader 130 or from the network 180 using network interface 170. During the bootstrap phase, an operating system and one or more software applications are loaded from the storage device 1030 into the memory 110. During the fetch-decode-execute cycle, the processor 1000 fetches computer program code instructions from memory 110, decodes the instructions into machine code, executes the instructions and stores one or more intermediate results in memory 100.

In this manner, the instructions stored in the memory 110, when retrieved and executed by the processor 1000, may configure the computing device 100 as a special-purpose machine that may perform the functions described herein.

The device 100 also comprises a video interface 1010 for conveying video signals to a display device 1020, such as a liquid crystal display (LCD), cathode-ray tube (CRT) or similar display device.

The device 100 also comprises a communication bus subsystem 150 for interconnecting the various devices described above. The bus subsystem 150 may offer parallel connectivity such as Industry Standard Architecture (ISA), conventional Peripheral Component Interconnect (PCI) and the like or serial connectivity such as PCI Express (PCIe), Serial Advanced Technology Attachment (Serial ATA) and the like.

Considering now the player interface 105, there is displayed in FIG. 1 the player interface 105 receiving various biometric and identification data for use by the computing device 100 in identifying problem gambling behavior.

Biometric Data Source 115

As is apparent from the figure, the player interface 105 is adapted for receiving various biometric data 115 for the purposes of assisting in problem gambling behavior. The player interface 105 may take on differing embodiments depending on the application as will be described in further detail below. However, there will now be described to the various data inputs into the player interface.

The various biometric data sources 115 are shown in dotted lines in FIG. 1 as the inputs of such data need not necessarily form part of the player interface in that they may be obtained from ancillary existing data sources as will be described in further detail below.

In a first embodiment, the player interface 105 is adapted for utilizing electrocardiograph data source 115*a* so as to measure the heartbeat of the player. In this manner, changes in heart rates may be indicative of problem gambling behavior as can be ascertained by the computing device 100. In this manner, the player interface 105 may interface with a heart rate monitor which has secured about the chest of the player. However, in a preferred embodiment, the heart rate monitor is adapted to be non-invasive so as to not necessarily detract from an enjoyable gambling process. In this manner, the heart rate monitor may take the form of electrical contacts or various forms of transducers making contact with the hands of the player so as to measure the heart rate of the player by measuring potential differences.

In a further embodiment, the player interface 105 may be adapted to receive skin conductivity biometric data source 115*b* indicative of skin conductivity of the player. Such skin conductivity may be indicative of the rate of perspiration of the player. Again, the skin conductivity meter may be designed in an unobtrusive manner. In one manner, the skin conductivity meter is adapted for generating a potential difference at two contact points of the skin of the player so as to measure the current flow so as to ascertain conductivity and therefore perspiration level of the player. In certain embodiments, perspiration may be indicated by a raise in skin temperature. In this manner, the player interface 105 may interface with an infrared sensor adapted for measuring radiated heat of the player.

In a yet further embodiment, the player interface 105 may be adapted for measuring pressure exerted by the player using pressure sensor source 115*c*. Such pressure may be indicative of excitement levels of the player. For example, the player interface 105 may take the form of a handheld device wherein, during use, the grip pressure (as may be indicative of problem gambling) may be ascertained by the handheld device using suitable strain gauge or the like.

In certain embodiments, the player interface 105, using the pressure sensor source 115*c* may be adapted to determine rate of gameplay. However, such rates may be additionally or alternatively determined using the in-game data.

In a yet further embodiment, the player interface 105 may be adapted for receiving image data representing at least one of facial expressions and gestures of the player. In this regard, the player interface 105 may comprise an image capture device orientated towards the player for capturing such image data. The computing device 100 or the player interface 105 may be provided with image recognition technique for the purposes of recognizing certain facial expressions gestures or the like, certain of which may be indicative of problem gambling.

In-Game Data Source 135

Furthermore, the computing device 100 may be adapted for receiving various in-game play data from in-game data source 135. Specifically, in-game play data may comprise any one of 1) game play outcomes (e.g. symbols and position on the electronic gambling machine screen), 2) selected "lines" and their positioning on the electronic gambling machine screen, 3) number of credits selected, credits being a measure or record of the number of units of the nominally being one (1) cent amount being gambled (providing typically maximum $4.50 wager for each game cycle (based on a one (1) cent per credit gaming machine).), 4) number of accumulated credits, 5) relationship of displayed electronic gambling machine symbols to pay table for the electronic gambling machine, 6) pay out per selected "line" of the electronic gambling machine, 7) total payout, and 8) total losses per game play.

It should be noted that the in-game play data may reside already within the memory 110 of the computing device 100 (such as where the computing device 100 takes the form of an electronic gambling machine). In this manner, so as to obtain such game play data, such game play data need only be retrieved from the memory 110 of the computing device 100, such as where the computing device 100 is adapted for identifying problem gambling behavior, or alternatively where such in-game data is transmitted across a network 180 to a server computing device 205 for identification of problem gambling behavior. The synchronization of the game play data, as described above, with the player player's observations of these game play data as illustrated at FIG. 6 and the corresponding biometric responses to this game play data, or game play synchronization feedback, is important to the embodiments described herein, especially in the training used by the artificial intelligence computation technique. In this implementation the SMLD device has been implemented as a "standalone" device 300.

In a yet further embodiment, the player interface 105 (or the computing device 100 (such where the computing device 100 takes the form of an electronic wagering Horse/Dog racing/sporting betting terminal). The player interface device may be adapted for receiving wager amount data representing wager amounts being wagered by the player. In order to obtain such data, such wager amount data may be received from a currency receiving device, card reader, financial institution or the like. The in-game data is this case may comprise any one of 1) Horse or Dog race outcomes, 2) betting strategies, 3) positioning of the Horse/Dogs racing relatively to one and other during the race, 4) the level of wagering of various Horses/Dogs involved in the race, 7) total payout, 8) total losses per race.

In a yet further embodiment, the player interface 105 (or the computing device 100 (such where the computing device 100 takes the form of an electronic wagering Casino type Table gaming devices). The player interface device may be adapted for receiving wager amount data representing wager amounts being wagered by the player. In order to obtain such data, such wager amount data may be received from a currency receiving device, card reader, financial institution or the like. The in-game data is this case may comprise any one of 1) Type of Table Game, 2) game outcomes (e.g. positioning of the selected bet as represented on the layout format of the selected Table Game), 3) the amount wagered/bet on any single or combination of table game outcomes, 4) the number of accumulated credits/bets on any defined Table game game outcomes, 5) total payout or win from a table game, 6) total losses per table game game cycle.

Identification Data Source 125

It should be noted that in certain embodiments, the computing device 100 may be adapted for receiving identification data for the purposes of identifying a player. Such identification data may comprise fingerprint data obtained from finger print reader 125*c*, facial image data obtained from facial image capture device 125*a*, iris image data obtained from iris scanner 125*b* of the player and the like. In this regard, the player interface 105 may comprise suitable biometric reader or the like for the purposes of recording such fingerprint data, facial image data, Iris image data and the like.

Yet further, and as will be described in further detail below, the identification data source 125 may take the form of a security device 125*c*, such as a device comprising a USB or other computer storage/interface device wherein the security device is adapted for storage of authentication credentials used for authenticating the player, player profile data used for storing a profile of the player, player identification data used for uniquely identifying the player and the like.

Player Interface 105

There will now be described the player interface 105 in further detail.

A player interface 105 monitors, (preferably non intrusively) selected biometric measurements of player. These biometric sources may include variations in heart rate, variations in skin conductivity, variation to facial expressions, variation to eye characteristics, variations in rate of game play, variations in the level of excitement, as measured by pressure grip of a control device used to operate the electronic gambling machine and variations in electronic gambling machine play strategies.

The measurements of each of the biometrics variables obtained from player interface 105 are utilized by the computing device 100 in conjunction with in-game data obtained from in-game data source 135 for detecting problem gambling behavior.

The game outcomes that are monitored may include (i) the three top paying combinations for the highest paying "Pay table" symbols. These are to include "Substitutes" and "Scatters" (where the Pay tables are a display on the electronic gambling machine of the various game combinations and their related prizes for these combinations, and Scatter and Substitutes are defined elements of the Pay Tables.), ii) the three top paying combinations for the second highest pay table symbols. These are to include substitutes and scatters and (iii) the two top paying combinations for the third highest pay table symbols. These are to include substitutes and scatters.

It should be noted that the term player interface 105 should not be construed in a technically limiting manner as the technical implementation of the player interface 105 may vary from application to application.

In this regard, the player interface 105 need not necessarily be construed as being a discrete device but may alternatively be represented as a combination of discrete hardware and software modules for the purpose of interfacing with the player for the purposes of receiving the various dates are described herein, including the biometric data, in-game data and identification data.

However, in a preferred embodiment, the player interface 105 is a joy stick control device which is connected to the electronic gambling machine by a physical cable connection, the joystick adapted to be held by the player during gameplay to control the gaming machine.

Alternatively, the player interface 105 may take the form of a wrist band. In this regard, the wristband may communicate by way of wired interface. Preferably however a wireless interface is employed, such as radiofrequency, infrared, audio link and the like.

It should be noted that in various embodiments, the player interface 105 may be "dumb" and comprising only certain sensors wherein the data output from the sensors is captured and manipulated by the associated computing device 100, whether this be the electronic gambling machine, player analysis server 205 (as will be described in further detail below) or the like.

However, in certain embodiments, the player interface 105 may comprise embedded processing, comprising substantially the technical integers as are given in FIG. 1. In this manner, the player interface is adapted for not only processing but also storage of various biometric data and the like. In certain embodiments as will be described in further detail below, the player interface 105, especially when applied for use in online gambling platforms, is adapted for storage of personal identification data, authentication data and the like. In this regard, the player interface 105 requires a memory device 110 adapted for such storage of personal identification data, authentication data and the like. Furthermore, the player interface 105, in comprising processing capabilities, is able to calculate maximum limits applicable to games being played by those players exhibiting problem gaming behaviour. In this manner, the player interface 105 may limit the electronic gaming machine using game limiting data representing such limitations as the maximum number of credits that can be applied to each game cycle and the like.

Player Interface 105 Adapted for an Electronic Gambling Machine

Differing embodiments of the player interface will now be described in further detail, wherein, as will become apparent, the player interface 105 is adapted for implementation with electronic gambling machines, online gambling using a personal computing device, online gambling using mobile communication devices (smartphones), gambling at casino tables, and gambling at wagering terminal.

In a first embodiment, the player interface 105 is adapted for interfacing with an electronic gambling machine. In this manner, the player interface 105 may be retrofitted to existing electronic gambling machines for the purposes of identifying problem gambling behavior so as to implement remedial action including that which is described herein, including limiting certain-game functionality, alerting authorities and the like.

Alternatively, as opposed to being adapted for retrofit, gambling machines may be manufactured with the player interface 105 in built.

The player interface 105 may of course take on differing embodiments as necessary for the purposes of receiving the data as described herein. Specifically, the player interface 105 may comprise a gaming control device such as a joystick, button, touchpad or the like adapted to make contact with the user for the purposes of measuring heart rate, skin conductivity, temperature and the like.

Player Interface 105 Adapted for Online Gambling

In a further embodiment, the player interface 105 is adapted for use in online gambling such as where a player utilises a personal computing device. As is apparent, there is no electronic gambling machine in online gambling for the purposes of incorporating a player interface 105. However, in this embodiment, a security device 145 such as a device USB device (or other dongle or the like) is required to be inserted into the personal computer 100 by the player.

The security device may store encrypted data for security purposes and comprise personal identification of the player, gambling profiles and the like. Furthermore, the security device may comprise authentication credentials adapted for use by the personal computing device in authenticating with an online gaming platform. In this manner, online gaming platforms may be restricted to only those players who have authentication provided by such a security device.

Furthermore, the security device may further comprise devices adapted for the purposes of receiving the biometric data, identification data and the like as described herein. For example, the security device may comprise a USB connection at one end and a handhold device at the other.

In this manner, the security device comprises information for the purposes of authenticating with an online platform but also comprises sensors 115 and 125 for measuring the biometric data, identification data and the like of the player. For example, the security device may comprise electrical contacts for the purposes of measuring the users' heart rate, skin conductivity and the like. Yet further, the security device may comprise a fingerprint reader for the purposes of capturing fingerprint scan data of the player for the purposes of identification. It should be noted that a combination of a security device and existing functionality of the player's personal computing device may be employed for the purposes of recording such information. For example, the security device may record the finger print data of the user whereas the web cam (not shown) of the players computing device may be adapted for capturing image data of the user's facial expression, gestures and the like.

The Player Interface device may be used to implement and limit the level of gaming interaction in a similar manner to those detailed for the electronic gaming machines detailed previously.

Player Interface 105 Adapted for Online Gambling Using Mobile Communication Devices In a related application, the player interface device is adapted for online gambling using mobile communication devices such as smart phones including iPads, iPhones and the like. In this embodiment, a security device 145 may be coupled with the mobile communication device, in a similar manner as described above with reference to online gambling using a personal computing device.

Player Interface 105 Adapted for Casino Table Games

In a further embodiment, the player interface 105 is adapted for use on casino table games and the like. In this application, the player interface 105 may take the form of a security device 145 or the like which is required to be inserted into a security device interface prior to the player being allowed to gamble. In this regard, gaming behavior data, player identification data and the like may be relayed to the croupier, such as by way of suitable communications link and display device to display information to the croupier. In such an embodiment, the interface 105 need not necessarily be able to capture biometric data from the player. However, in other embodiments, the casino table may be provided with appropriate senses, such as conductive contact pads adapted for making contact with the skin of the player so as to measure skin conductivity, heart rate and the like.

The limits on gambling levels and strategies may be controlled by the Croupier, based on recommendations communicated to the Croupier by the Player interface device 105 and computer 100.

Player Interface 105 Adapted for Wagering Terminals

In a yet further embodiment, the interface 105 may be adapted for use in conjunction with wagering terminal. In this embodiment, betting limits are imposed on all players unless the player is able to produce a security device 145. If a security device is produced, there is recorded the biometric data and player analysis history recorded as previously together with an assessment of that player as a problem or non problem gambler, further recording of that analysis is recorded on the security device for the duration of the race.

In the embodiment where a player is deemed to exhibit addictive or problem gambling behavior or there is less than a defined player history or the player has not used a security device, the wagering terminal may be adapted for imposing maximum predefined limits on amounts waged.

Security Device 145

Again, the security device 145 should not be construed with any particular technical limitation in mind. Specifically, the security device 145 as shown in FIG. 1 is exemplified such for convenience only. In this manner, the security device 145 may comprise a combination of the player interface 105 so as to be adapted for obtaining biometric data and identification data sources 125 so as to be adapted for obtaining identification data.

Specifically, the security device 145 may take the form of a USB device, such USB device comprising encoded identification data and the like, yet while also comprising various sensors 115 adapted for obtaining the biometric data as described herein.

Alternatively, the security device 145 may take the form of a smartcard; the smartcard comprising a ROM memory device is adapted for storing identification data, authentication data, player profile data and the like. In this embodiment, the security device 145 need not necessarily comprise sensors 145 for the purposes of obtaining biometric data. Rather, such biometric data may be obtained by separate sensors.

In a yet further embodiment, the security device 145 may take the form of a read only storage device, such as a magstripe, barcode or the like wherein a unique identification number encoded thereon is used for the purposes of looking up the players identification data, authentication data, player profile data and the like. In this manner, such data may be securely stored on the player analysis server 205 (as will be described in further detail below).

System 200 for Automating the Detection of Problem Gambling Behaviour

Figure 2:
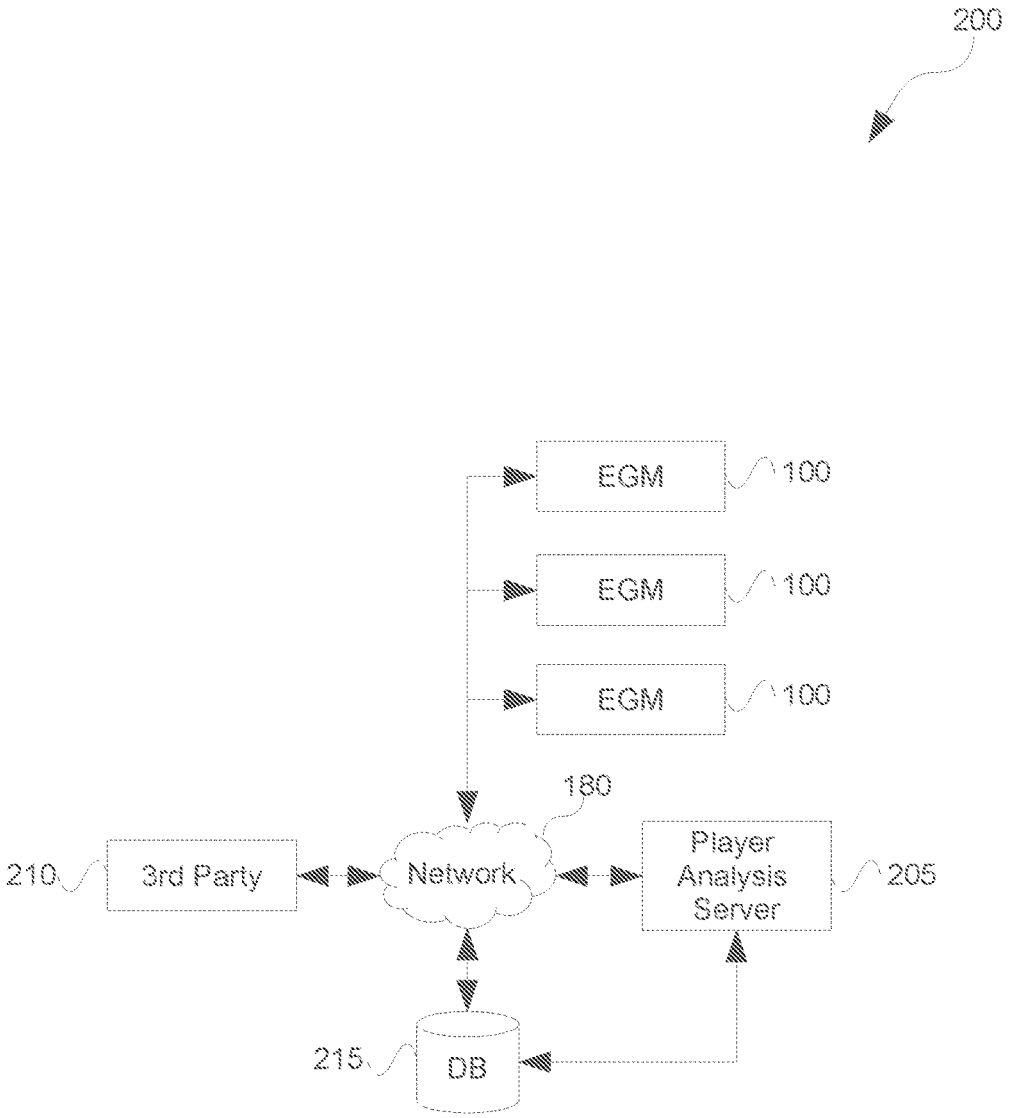
FIG. 2 shows a network of computing devices on which the various embodiments described herein may be implemented in accordance with an embodiment of the present invention.

Turning now to FIG. 2, there is shown a system 200 for automating the detection of problem gambling behavior. As is apparent, the system 200 as substantially shown in FIG. 2 takes the form of a distributed computing system comprising a plurality of computing devices and communication by way of computer network 180.

However, it should be noted that the functionality described herein need not necessarily be implemented by way of distributed computing system as substantially shown in FIG. 2. Rather, such functionality may be implemented, for example by way of stand-alone computing device, such as an electronic gambling machine 100 provided with computer program code and dataset configuration for the purposes of receiving biometric, identification data, in-game data and the like for the purposes of identifying problem gambling behavior.

However, in a preferred embodiment, the system 200 as substantially shown in FIG. 2 is employed for the purposes of efficiencies in data propagation, distribution and the like allowing potentially tens of thousands of electronic gambling machines 100 to be monitored for problem gambling behavior. As opposed to utilising the distributed architecture as described substantially in FIG. 2, the security device 145 may alternatively be employed for porting identification data player profile data and the like from one electronic gaming machine 100 to another.

The system 200 comprises a centralized player analysis server 205 adapted for the purposes of identifying problem gaming behavior. The system furthermore comprises a plurality of electronic gambling machines computing devices 100. In this manner, the electronic gambling machines 100 adapted for sending biometric data, identification data, in-game data and the like across the network 180 to the player analysis server 205. Upon receipt of such data, the player analysis server 205 is adapted for identifying problem gaming behavior in accordance with the data. The server 205 is furthermore adapted to send, in reply to the respective electronic gaming machine 100, and a reply as to whether the server has identified the player as exhibiting problem gaming behavior or not, such that the game play of the relevant electronic gaming machine 100 may be limited in some manner.

It should be noted that variations to the embodiment as substantially provided in FIG. 2 may be employed depending on the application within the scope of the purpose of identifying problem gaming behavior as described herein. Specifically, each electronic gaming machine 100 need not necessarily send to the player analysis server 205 the biometric data and the like. Rather, the player analysis server 205 may be adapted to send discrimination data to each respective electronic gaming machine 100 such that each respective electronic gaming machine 100 is adapted for performing the computational steps in identifying problem gaming behavior in accordance with the discrimination data.

The system 200 further comprises a database 215 adapted for storing various data including the data described herein. Specifically, the database 215 may be adapted for storing player profile data representing the identification, player habits and the like of each player using the system 200. Furthermore, the database 215 may be adapted for storing discrimination data generated by machine learning and artificial intelligence computing technique (as will be described in further detail below), for the purposes of use in the identification of problem gaming behavior.

Furthermore, the system 200 comprises a third-party interface 210 for interfacing with the system 200. The third party interface 210 may be adapted for various purposes, including for interface with various governmental or authoritative institutions for the purposes of receiving information as to problem gambling behavior. Yet further, the third-party interface 210 may be adapted for the purposes of providing discrimination data for the system 200.

Alternatively, the system may operate without the use of networks or database devices. In this instance, existing gaming venues may operate with minimal modification, other than the installation and integration of a supervised machine learning device (SMLD—which may take the form of a stand-alone computing device 100 in operable communication with the electronic gaming machine or alternatively implemented by the electronic gaming machine 100 itself through suitable software modification).

Players may operate the gaming devices without the use of a player interface 105, without using a security device 145 and therefore circumvent the use of the built in SMLD device. If this operating option is taken then the player and the gaming machine 100 will operate in a "default mode". The default mode of operation will limit gambling levels, which may be set at those levels used by recreational gamblers.

If the players choose to use the player interface 105 and the security device 145 and therefore the inbuilt SMLD device, then there are three options of gambling; firstly if the security device 145 recorded player history does not identify the player as being a pathological gambler, then there will be no limitations imposed on the player; If during the game play sessions the player exhibits the defined traits, as assessed by the SMLD device, of a pathological gambler, then gambling limitations will automatically be imposed; finally if the security device 145 has less than a predefined history of gambling, then the default gambling limitations will be imposed until such time as that predefined play history has been recorded (assuming that during that data and statistical data gathering period, the player is not assessed as being a pathological gambler).

Artificial Intelligence Discrimination/Discrimination Dataset Generation

As will now be described in further detail below, the system 200 is adapted for employing artificial intelligence techniques and the like for the purposes of discriminating between problem gamblers and non-problem gamblers.

Of these embodiments, the player interface 105 (where the player interface 105 is provided with processing capabilities) or the computing device 100 is adapted for implementing artificial intelligence techniques by way of supervised machine learning using artificial neural networks.

Such supervised machine learning using artificial neural networks is an information processing technique loosely based on the way biological nervous systems, such as the human brain, operate. In this regard, the computing device 100 contains a number of connected processing units called neurons which, operating in concert, have the capacity to learn from examples to solve specified problems. The process whereby the computing device 100 receives examples of problem gambling behavior and non problem gambler behavior (which are elaborated further below) is referred to as a training phase which may be a once off configuration process or alternatively and incrementally learning process depending on the application.

The training phase is achieved by initially utilizing persons that have undertaken a detailed and accredited psychological profiling or screening so as to differentiate those who exhibit problem gambling behavior from those that do not.

The profiling or screening analysis will categorize each of the participants in the supervised machine learning/training phase, as either non addicted gamblers or addicted problem gamblers (defined as a pathological gambler). There may be several levels of addictiveness included in the profile, the highest level of addictiveness being classified as that of the Pathological gambler.

The sample size required to train the system is typically one hundred (100) persons. That is a confirmed group of 100 pathological addictive gamblers and 100 persons in each of the selected levels of addictive gamblers lower than the highest level of pathological gamblers. There are also to be a typical sample group of 100 non addictive gamblers. These are hereafter referred to as recreational gamblers.

Neural Network Training for the Purposes of Identifying Problem Gambling Behaviour The profiled or screened gamblers will undergo normal gaming machine operations in a "live" and fully operational gaming venue where every gaming machine or gaming device at that venue may be used for the data monitoring, or data capture, process (where the monitored and captured/recorded experimental data will subsequently be used for the "once off" training process). The artificial intelligence device (referred to as a Supervised Machine Learning Device which contains an artificial neural network, which requires training, is referred to as an SMLD Device) may be configured in several forms in this embodiment. The SMLD device may be a "standalone" device forming part of unit 110 where it will be integrated into the Gaming Device processor, or it may be implemented in software as part of the gaming device 100 or it could also be implemented as part of the Player Analysis Server 205 in a networked solution. It will be explained later how the data capture process relates to the Training process. Each of the gaming machines or gaming devices (such as gaming tables or wagering terminals) 100 configured with a player interface 105 and an SMLD, which may be configured on one of many implementations as described earlier, will be used as the data capture and training unit so as to provide assessments of the levels of addictiveness.

All of the screened electronic gaming machine players, together with other forms of addictive gambling behavior, referred to as experimental subjects, will be monitored under reasonably realistic gaming conditions. The data recorded under these monitoring conditions will be referred to as Experimental Data. The Experimental Data for each experimental subject, consists of biometric responses under various gaming scenarios and any other relevant data, as well as the experimental subject's assessment as addicted (pathological gambler) or non-addicted (Recreational gambler).

There will be typically two hundred (200) experimental subjects involved in the initial training phase, therefore it would be feasible to have 200 experimental subjects, being monitored, playing 200 gaming machines or other gaming devices which require separate forms of training, however, provided the experimental gaming operations are monitored and the experimental data recorded (for subsequent use in the Training Process) there can be any number of gaming machines or gaming devices uses as part of this data capture phase (these gaming devices may include Casino Table Games, Horse and Grey Hound racing when being part of the Wagering variant of this embodiment, together with other forms of gambling methods and implementations). Once the experimental data has been collected for all of the experimental subjects, the training phase takes place. This is independent of the experimental monitoring phase as described previously. It should be noted further that whilst there is only a "once off" training phase required, there is provision within this embodiment for ongoing or incremental training phases. This may be used as part of improving the accuracy of the problem gambling detection and control methods.

The training phase may utilizes a suitable analytical techniques, including those described herein, together with algorithms provided to determine the neural network architecture, whose configuration is optimized using methods described herein, together with values for its weights, that most accurately enables the discrimination between addicted (pathological gamblers) and non-addicted (Recreational gamblers) experimental subjects. Note some of the experimental data will be allocated to the training set, some to the validation set and some to the test set, as explained in this document.

Once the optimum neural network architecture, together with its associated weights has been determined, this is what is used in each instance of the detection device (SMLD) to be installed into each gaming machine or the other various implementations of gaming devices for which this application is to be applied.

The optimum neural network architecture and its associated weights can be stored in a file using some appropriate representation.

Each SMLD detection device will include a copy of the file which defines the optimum neural network architecture and its associated weights. This is defined as the trained network of SMLD.

Whenever the software of the SMLD detection device starts running, this file can be read and its contents used to construct in memory a data structure representing the trained SMLD network.

It is the SMLD (the trained network) that undertakes the assessment of an addicted (Pathological gambler) or Non-addicted (Recreational Gambler).

The relevant Observed Data for any gambler at any point in time is read into the input neurons of the trained network (SMLD), data is run forward through the network and the assessment of addicted (Pathological) or non addicted (Recreational) gambler is determined by the resulting output value of the output neuron.

Problem Gambler Behaviour Detection Walk-Through

There will now be described a walk-through of the process employed by the system 200 in detecting problem gaming behavior. In this regard, the system 200 is adapted to detect addicted individuals in the course of their playing on gambling machines and, second, to reduce the gambling intensity of gambling machines being used by individuals who have been detected or assessed as being addicted. The assessment of addictedness will depend on a number of monitored variables. These variables will fall into three categories.

In a first step, the system 200 monitors biometric variables such as blood pressure, heart rate, skin conductivity and rapidity of game play activations. As alluded to above, such monitoring is performed by the player interface 105. In a preferred embodiment, such variables are monitored by a hand-held player interface 105 wherein such variables are monitored by sensors embedded in the hand-held device (the player interface 105) which the gambler will be required to hold during play. In this regard, the hand held device may include embedded pressure sensors to measure the level of arousal or anxiety. Additionally, the hand held device may be equipped with a button that will have to be pressed by the thumb to initiate each game. In a preferred embodiment, a fingerprint reader is embedded in the button will provide a means of verifying the identity of the person using the gaming machine, together with a digital facial image of the player. This will be one of the identifying items required to redeem winnings from gaming machines and other gaming devices. In certain embodiments, the handhold player interface 105 may further comprise other input devices such as video capture devices and the like for recording data relating to facial expressions, eye movements and the like.

Further, the system 200 is adapted for monitoring in-game data, including those related to the individual gambler's wins and losses in the course of play. There may be a set of generic gaming scenarios, independent of specific games and specific gambling machines The relevant regulatory authority will have to require each manufacturer of gambling machines to make accessible to a monitoring device in real-time the generic gaming scenarios that arise in the course of play on any one of their machines. Such measures are necessary to enable the variables involving gaming scenarios to be monitored across a range of games and gambling machines.

Yet further, the system 200 will receive or calculate various summary statistics, such as frequency and duration of play, related to the individual gambler's playing habits.

As such, the system 200 is adapted to record the biometric variables and the variables involving gaming scenarios. There will also be recorded by the system 200 history of the details of a gambler's playing habits for use in the calculation of the above summary statistics mentioned above. Such information will be recorded on a player's security device 145 that may be required to be inserted in a gaming machine 100 for the duration of play on the machine in certain embodiments. In alternative embodiments, such information may be recorded within the database 215 and retrieved by the system 200 upon receiving a unique identification of the player.

Some of the monitored variables, typically the biometric variables, may be sampled at regular short time intervals; others, typically those involving gaming scenarios, will be sampled once per game played.

As such, having received the information described above, the system 200 is then adapted for detecting problem gambling behavior in accordance with the above-mentioned monitored variables. The development of this assessment system will rely on an existing clinical psychological test with the capacity to rigorously differentiate addicted and non-addicted gamblers. It is important that the operation of the assessment system will not require an individual being assessed to have already taken the psychological test. This means that any gambler using gambling machines will be capable of being assessed.

Neural Network Training

There will now be described in further detail below the process for generating the above-mentioned training data, and the utilization thereof.

Experimental studies under realistic gambling conditions will first determine which variables capable of being monitored are individually of statistical significance to the assessment of addictedness, with the psychological test providing the differentiation of addicted and non-addicted gamblers. These studies will then determine what combinations of monitored variables are of most statistical significance to the assessment of addictedness. Such combinations of monitored variables will form the basis of the assessment system.

Modeling the dependence of an assessment of addictedness on the monitored variables is nonlinear and complex for which no clear analytical framework is apparent. As such, there is provided, the system 200 employing supervise machine learning techniques including (artificial) neural networks.

Specifically, the artificial neural network system utilizes neural networks which provide the level of performance required for the detection of problem gamblers.

The artificial neural network is an information processing system loosely based on the way biological nervous systems, such as the human brain, operate. An artificial neural network consists of number of connected processing units called neurons which, operating in concert, have the capacity to learn from examples to solve specified problems. The process whereby an artificial neural network learns from examples is called training.

Each connection in an artificial neural network connects one neuron to another neuron and has a defined direction (from neuron A to neuron B). Each connection also has an associated numerical weight. The weights will, in general, be different for different connections, but are fixed in the course of the normal operation of the artificial neural network (that is, when the artificial neural network is being used operationally, as opposed to being trained). A connection can also carry a numerical value and this value can change in the course of the normal operation of the artificial neural network.

The typical scheme for processing information within the artificial neural network is that a neuron first calculates a weighted sum of the numerical values carried by the connections coming into the neuron, the weights being those associated with the incoming connections. A numerical bias term is then added. This bias term is associated with the neuron and can be different for different neurons, but does not vary in the course of the normal operation of the artificial neural network. A function called a transfer function (or activation function) is then applied to yield an outgoing value, which is then carried by all outgoing connections from the neuron. The transfer function is usually arranged to be the same for every neuron in the network. It yields a value in a restricted range, typically the interval from −1 to 1 or the interval from 0 to 1. Transfer functions are chosen to be suitable nonlinear functions (smooth, bounded and monotonic) because this allows the modeling of nonlinear data. There is often also a threshold value associated with a neuron. This can be different for different neurons, but again it does not vary in the course of normal operation. The point of the threshold value is that if the argument of the transfer function does not exceed the threshold value, the transfer function is not applied and the outgoing value of the neuron is taken to be, say, zero. In this case, the neuron is said not to fire or not to be activated. If the threshold value is exceeded, the neuron is said to fire or to be activated.

An operating artificial neural network takes one or more input numerical values. Each input value is associated with a distinct neuron called an input neuron which receives the input value. Information (in the form of numerical values) is then propagated along the connections of the artificial neural network from the input neurons to other neurons. Each neuron processes the values carried on all of its incoming connections and produces an outgoing value as described above (depending on the incoming values, as well as the weights on the incoming connections and, possibly, a bias term and a threshold value). The outgoing value is carried along outgoing connections to other neurons. Eventually values reach one or more neurons having no outgoing connections. These are called output neurons. Now the output value produced by each output neuron is a function of the original input values. Because there are one or more output neurons, an operating artificial neural network generates, for each set of inputs, values for one or more functions of the inputs. An operating artificial neural network can therefore be viewed as a machine for calculating one or more functions of one or more input variables.

Method of Training an Artificial Neural Network for Detecting Problem Gambling Behaviour There will now be described a method of training an artificial neural network to calculate, at least approximately, one or more functions of one or more input variables for the purposes of identifying problem gambling behavior. Assuming, first of all, that the artificial neural network has one input neuron for each input variable and one output neuron for each of the functions (of the input variables) that one wishes to approximate. The functions that are approximates need not be known in any precise sense, but what is required is the known values of these functions in a certain number of representative instances. This set of example values is a finite set of combinations of input values together with the corresponding function values, and is divided into three mutually exclusive sets intended to be statistically independent: a training set, a validation set and a test set. The operating artificial neural network has weights associated with the connections between neurons. There are also, possibly, bias terms and threshold values associated with the neurons, but, for simplicity, these are ignored. The connection weights do not change as different input values are supplied to the artificial neural network and the resulting output values are computed. Suppose that the connection weights are given. For every combination of input values contained in the training set we can compare the output values computed by the artificial neural network with the function values contained in the training set. One can then calculate a measure of error that the artificial neural network generates relative to (the true values contained in) the training set. This measure of error depends on the given connection weights. Training the artificial neural network is the process where one solves for the connection weights that minimize the measure of error relative to the training set. Once these connection weights have been determined, the validation set is used to check the accuracy of the artificial neural network on data independent of the training set.

The main technique used for training artificial neural networks is an algorithm called back propagation for the purposes described herein. In essence, back propagation is a gradient descent method that seeks the path of steepest descent on the error surface implied by the training set. Gradients depend on differentiability and differentiability of the error surface will be assured provided that the transfer functions are chosen to be differentiable, as they usually are. Issues that can arise with back-propagation are computation time and the possibility of ending up in a local minimum, as opposed to a global minimum, of the error function. Other optimization techniques are possible for training artificial neural networks, either replacing back propagation or operating in combination with back propagation.

As for the operation of the test set, different artificial neural networks (equipped with the required input and output neurons) will generate different measures of error on the given training set, and, clearly, less error is preferable to more error, everything else being equal. Now the main way in which artificial neural networks differ is in the number of their neurons and in the way the neurons are connected. This can be called the artificial neural network architecture. One can search for the artificial neural network architecture (having the required input and output neurons) that minimizes the (measure of) error on the training set. This is equivalent to searching for the artificial neural network architecture that maximizes accuracy on the training set. This search must be qualified by practical considerations such as 1) keeping the size of network within feasible bounds and 2) checking the accuracy level on the validation set. Note that the search depends on both the training set and the validation set, and, if successful, yields an artificial neural network architecture with acceptable accuracy on both these sets. A potential problem is that the artificial neural network architecture yielded by the search is "over fitted" to the training set and the validation set which were used in the search. The test set is used to check the accuracy of the artificial neural network architecture on a set independent of the search process. Keeping the artificial neural network architecture "as small as possible and as large as necessary" helps to prevent "over fitting". Making the training set large enough is also important.

The optimization of the artificial neural network architecture involves discrete variables such as the number of neurons. This means that the many optimization techniques relying on smoothness criteria cannot be applied.

Figure 3:
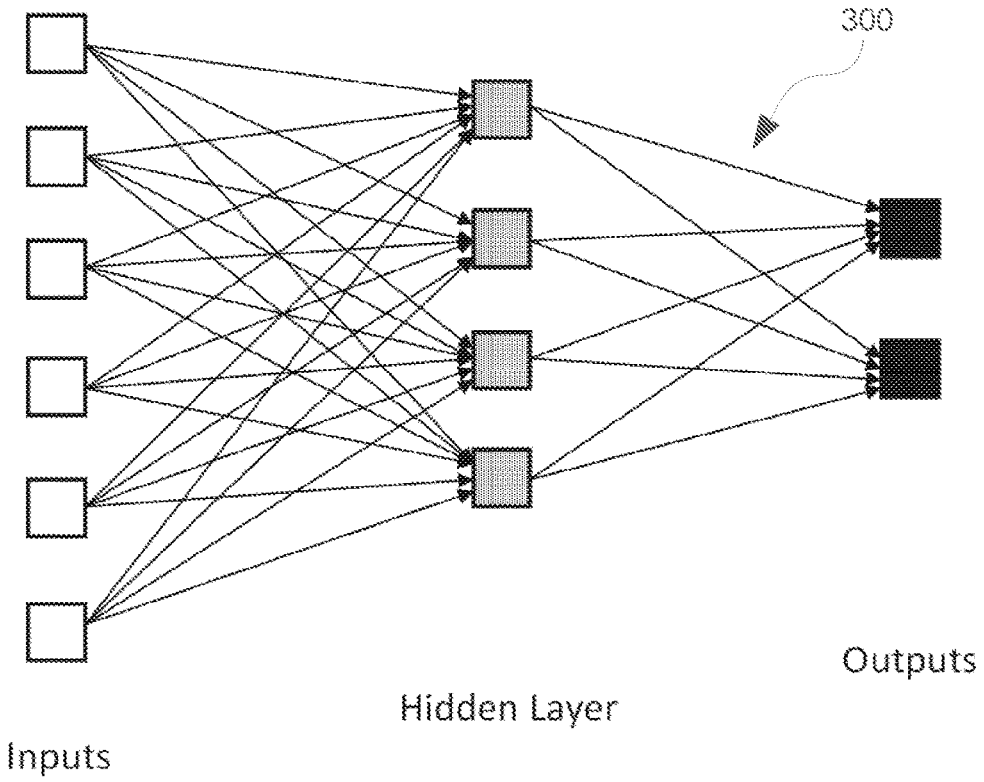
FIG. 3 shows a feed forward neural network on which the various embodiments described herein may be implemented in accordance with an embodiment of the present invention.

In terms of the artificial neural network architectures which may be applicable in detecting problem gaming there are feed forward artificial neural networks wherein neurons are arranged in several successive layers: the first layer consists of the input neurons, the last layer consists of the output neurons, and every neuron of any given layer has connections only into neurons of the following layer. Referring now to FIG. 3, there is shown a feed forward artificial neural network 300 with three layers, one so-called hidden layer being intermediate between the input and output layers:

In the feed forward artificial neural network 300, paths along the connections between neurons (in the directions associated with the connections) do not contain cycles or loops.

Figure 4:
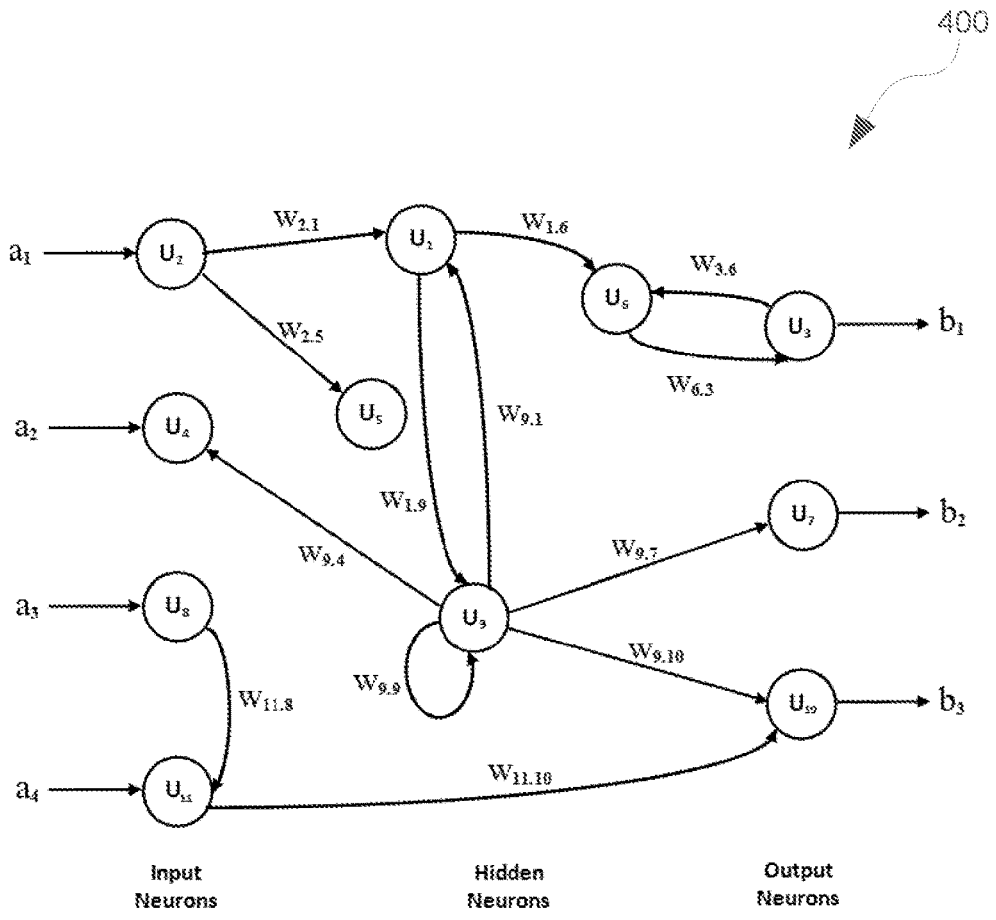
FIG. 4 shows a recurrent artificial neural network on various embodiments described herein may be implemented in accordance with an embodiment of the present invention.
Figure 5:
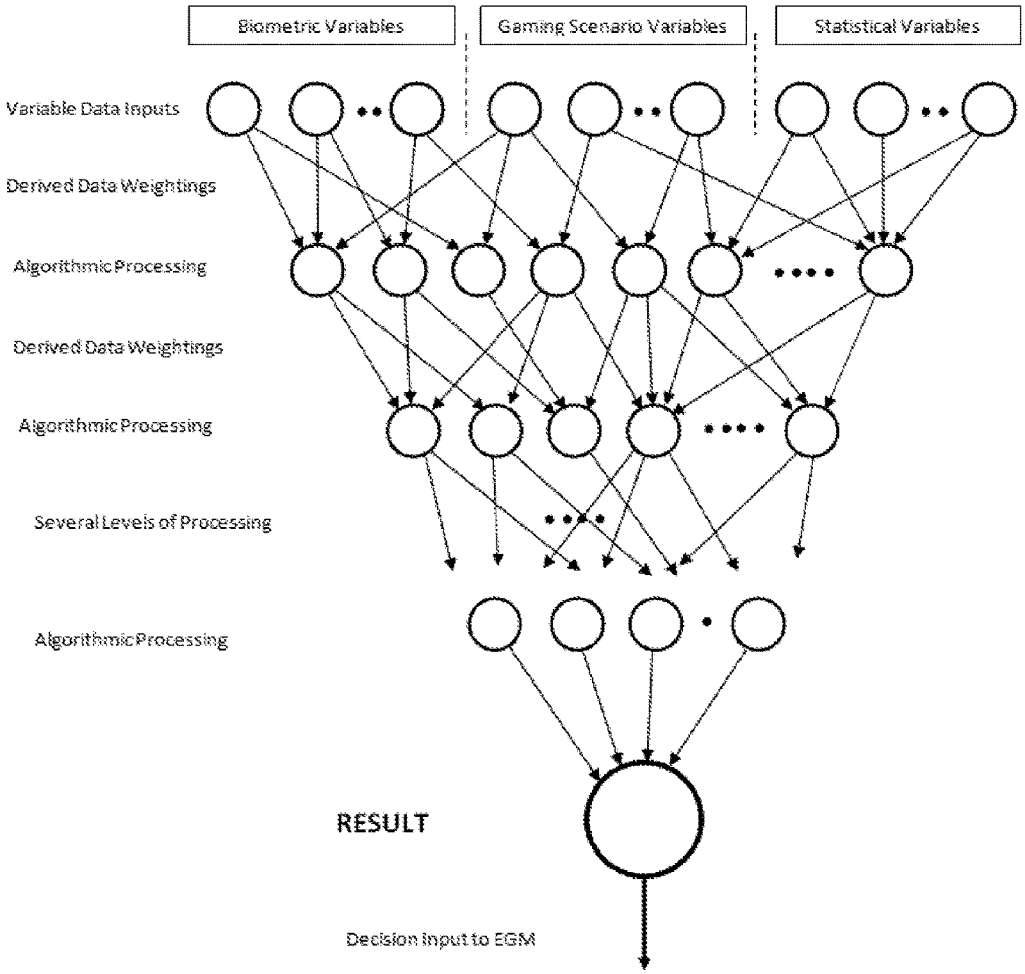
FIG. 5 shows a feedback neural network on which the various embodiments described herein may be implemented in accordance with an embodiment of the present invention.

Conversely, in recurrent artificial neural networks 400 (as is exemplified in FIG. 4); there are paths along the connections between neurons (in the directions associated with the connections) that do contain loops.

Recurrent artificial neural networks can be more powerful than feed forward artificial neural networks, but training them can be more difficult (and back-propagation is not applicable). They can be used to model time-sequenced data in a more sophisticated way than, say, using one input neuron for each of the last N observed values of a variable. In particular, they have the capacity to store memory going further back in time than the data assigned directly to the input neurons.

The applicant initially utilized a feed forward artificial neural network, with a single hidden layer and with some variant of back propagation as the training algorithm, to produce the output assessment of addictive gambling. The applicant investigated whether the use of several hidden layers increased the accuracy of assessment and what impact this may have on computational efficiency. The applicant investigated how other algorithms, a global optimization and other techniques can be used in combination with back propagation to produce improved training algorithms for a given artificial neural network. The applicant also investigated the use of a new global optimization algorithm, and other techniques to optimize the artificial neural network architecture. Finally, the applicant investigated the use of alternative training algorithms and the applicability of recurrent neural network architectures. Such experimental results are provided in appendix A.

Exemplary Embodiment

There will now be described in further detail an exemplary embodiment is performed by the system 200 in determining problem gaming behavior and the handling thereof. It should be noted that the steps described below are exemplary only and that variations, alterations and additions and deletions may be implemented within the purpose of scope of the embodiments described.

In a first step, the computing device 100 and player interface 105 monitor player biometrics and in-game play statistics.

No physical monitoring devices are required. Any player has the option of inserting a personal security device 145 into the electronic gambling machine 100.

Biometric measurements are obtained from the player interface 105, which may be gripped by the player. Where the player interface 105 is unable to obtain biometric measurements, the gameplay will be suspended/paused until such time that such measurements are obtained.

The player may initiate a game playing session with an electronic gambling machine in one of three ways, each method will impact on how that game session progresses. Specifically, 1) the player may commence the game play without using a security device 145, 2) the player may commence the game play using a security device 145, (such as where there has been less than four (4) hours of recorded play on the security device 145) and 3) the electronic gambling machine player may commence the game play using a security device 145 where there has been more than four (4) hours of recorded play on that security device 145.

Where the player commences the game play without using a security device 145, the player will be limited to a maximum bet range per gaming cycle. Typically the maximum bet per gaming cycle is 450 credits. For a 1 cent credit machine, which is the norm, this relates to $4.50 per game cycle. The limitation of the maximum bet can be specified by any jurisdiction and must be adjustable without impacting on the jurisdictional approvals of the electronic gambling machine.

Where the player may commence the game play using a security device 145 if there has been less than four (4) hours of recorded play on that security device 145, the player limitations shall remain the same as those for a player that chooses to commence game play without using a security device 145 so as to limiting a situation of a problem gambler claiming to have lost or chooses not to not use the smartcard, especially where the security device 145 has a history of the user being a problem gambler. The four hour threshold period is sufficient time for the player analysis server 205 to assess the defined characteristics of the player as to whether the player is in fact an addictive or problem gambler. When the four hour threshold period is exceeded the third game playing session, as defined below will be applicable, provided the player analysis server 205 has not assessed the player as a problem gambler.

Where the player may commence the game play using a security device 145, where there has been more than four (4) hours of recorded play on that security device 145, provided the player history recorded on the security device 145 has not defined the player as being a problem gambler, there will be unimpeded operation of the electronic gambling machine at its maximum gambling limits.

If the player interface 105 is unable to record the designated biometric measurements as previously defined for a period greater than a designated and predetermined period, then the player will be notified of this prior to the electronic gambling machine 100 reverting to an operational mode the same as that established for a player not using a security device 145 and that of a problem gambler.

A player that has not used a security device 145 can redeem winnings from a payment kiosk at the gaming venue in the same manner that is currently used in the majority of venues. Payment is made provided it can be verified that there was not a security device 145 used on the electronic gambling machine for which payment is sought.

A player that has used a security device 145 can only redeem winnings from a venue kiosk by presenting a security device 145 that is registered against the electronic gambling machine from which the winnings have occurred. The winnings are recorded on the security device 145 and are cancelled from the security device 145 when the payment is made. The security device 145 is inserted into a security device 145 card reader at the Kiosk. This will result is the display of a facial image of the player. If this facial image is not consistent with that of the person making the claim for payment of the winnings, then no payment can be authorized.

Where the player disputes classification by the player analysis server 205, it should be noted that research supports assertions that more than 85% of addictive and pathological (problem) gamblers are in denial of this addiction. Therefore it is anticipated that many of those players that are assessed by the player analysis server 205 as being problem gamblers will challenge that assessment. In order to cross check the validity of the assessments made by the player analysis server 205 and also to appease those players of an adverse assessment, an authorized psychological profiling device will be provided to all venues which operate electronic gambling machines with the player analysis server 205 device installed in those electronic gambling machine units. The psychological profiling device is to be certified as an appropriate assessment tool by an independent organization that is responsible for screening of players.

If the assessment of the psychological profiling device supports assessment made by the player analysis server 205, then the previously defined controls are upheld. However, if psychological profiling device assesses the player as a non addictive, non problem gambler, then the player security device 145 device is reset to that of a non problem gambler.

The problem gamblers that are assessed and reconfirmed as being problem gamblers are to be referred to an addictive and problem gambling clinic.

Appendix A—Experimental Results

One hundred and ninety two (192) experimental subjects were used for the preliminary analysis phase. Each experimental subject was a gambling individual who was observed in the course of gambling and for whom a number of samples was produced. Each sample consisted, potentially, of four measured physiological reactions, of an individual, to each of three different gaming scenarios, as well as the individual's recent average daily time devoted to gambling and the individual's psychological assessment (or categorization) as addicted or not addicted. For each individual, initially, none of the three gaming scenarios, together with their associated physiological reactions, had been observed. As each gaming scenario occurred in the course of play, a sample was produced recording (the cumulative history of) which gaming scenarios had been observed and the values for the associated physiological reactions, as well as the individual's recent average daily time devoted to gambling and the individual's psychological assessment as addicted or not addicted. If a gaming scenario reoccurred, the associated physiological reactions were updated with the most recent values. The production of samples was stopped, for each individual, as soon as all three of the gaming scenarios had been observed. Thus, for any given experimental subject, there was only one sample in which all three gaming scenarios had been observed; in all of the remaining samples, for the given experimental subject, either one or two of the gaming scenarios were unobserved.

The experimental subjects included 96 addicted gamblers and 96 non-addicted gamblers. This over-represents addicted gamblers, given the relatively low frequency of addicted individuals in the general gambling population, but the small sample size required addicted gamblers to be over-represented if there were to be more than a very few samples of addicted gamblers. In a full-scale analysis, one could either have addicted gamblers appearing in the samples with the same frequency as they appear in the general gambling population (that is, taking random drawings from the total population of gamblers) or, what is more likely, one could over-represent addicted gamblers in the original samples (taking random drawings from the population of addicted gamblers and also random drawings from the population of non-addicted gamblers) and then use randomly selected repeats of the original samples for non-addicted individuals so as to ensure that the relative frequency of addicted to non-addicted gamblers in the total set of generated samples matches the known relative frequency in the general gambling population. This latter strategy should allow more efficient extraction of information from the sampling process.

Each measured physiological reaction was shifted and scaled to give a number in the continuous range from 1 to 4. Since we had to be able to cater for the case where one or more of the gaming scenarios had not been observed for a given individual, we used, for each gaming scenario, the number 1 to indicate that the gaming scenario had been observed and the number 0 to indicate that the gaming scenario had not been observed. If a gaming scenario had not been observed, the values for the four associated physiological reactions were all set to the number 0 (not observed or not applicable). If a gaming scenario had been observed more than once, the values for the associated physiological reactions were taken to be the most recent values. The individual's recent average daily time devoted to gambling was indicated by a non-negative number. The individual's assessment as addicted or not addicted was indicated by a 1 (addicted) or a 0 (not addicted).

There was randomly allocated 96 of the 192 experimental subjects to provide training data and the other 96 to provide validation data. There were 47 addicted and 49 non-addicted individuals in the group allocated to provide training data. The training set consisted of all the samples produced for the individuals in the group allocated to provide training data. The total number of samples in the training set was 541. There were 49 addicted and 47 non-addicted individuals in the group allocated to provide validation data. The validation set consisted of all the samples produced for the individuals in the group allocated to provide validation data. The total number of samples in the validation set was 515. In only 96 of these 515 samples had all three gaming scenarios been observed. These 96 samples were called the fully observed validation samples.

There was implemented a feed forward neural network with one hidden layer to perform the task of differentiating addicted and non-addicted gamblers. The neural network used logistic (sigmoid) activation functions with biases, but with no thresholds for activation. The back propagation algorithm was used for training, with weights and biases being initialized with random values. There were 16 input neurons, five input neurons for each of the three gaming scenarios and their four associated physiological reactions, and one input neuron for the time input. There was one output neuron for the neural network's assessment of addictedness.

Recall that the term feed forward refers to the straight forward way (layer by layer, from the input layer to the output layer) that a given neural network, equipped with given weights (and biases), calculates outputs as a function of inputs. The back propagation algorithm, given certain weights (and biases) and a training set, calculates the error of the neural network's calculated output values compared with the correct values provided by the training set. If this error is not zero, the error is propagated back progressively, layer by layer, from the output layer to the input layer and, as a result of this backward propagation of error, a vector of weights (and biases) is determined which gives a direction in which the error (of the neural network's calculated output values compared with those provided by the training set) is decreased. This allows the weights (and biases) to be adjusted in a way that decreases error (by taking a sufficiently small step in the direction of decreased error). If the resulting error (after adjusting the weights (and biases)) is still not zero, the back propagation algorithm can be applied again to decrease the error. Thus we get an iterative procedure for decreasing the error. One can prove that if the steps taken (in the direction of decreased error) are infinitesimally small, then back propagation, applied iteratively, will converge to a local minimum of the neural network's error surface (which depends on the training set). There is no guarantee that the local minimum is a global minimum. Also, given different starting weights (and biases); convergence can give different local minima.

There was carried out training for 100000 iterations of the back propagation algorithm. At iterations 2000, 10000, 20000, 40000, 60000, 80000 and 100000, we checked the trained network's accuracy of assessment on the training set, on the full validation set and on the validation set consisting of the fully observed validation samples. Because most of the validation samples were only partially observed, one should expect reduced accuracy of the network when the full validation set is used. A better guide to the accuracy achievable by the neural network in practice is when accuracy on the set of fully observed validation samples is used. This corresponds to the fact that, in practice, there will need to be a settling in period before enough data is observed on which a meaningful assessment of addictedness can be made. Thus we have taken the set of fully observed validation samples to be the appropriate validation set to use when estimating achievable accuracy from the tests we have carried out.

In practice, one wishes to stop training when the accuracy on the validation set is maximized. Typically, the accuracy on the validation set increases (as the number of iterations increases) to a maximum and then starts decreasing down to some level, while accuracy on the training set increases until it levels off. Training beyond the point where accuracy on the validation set is maximized tends to lead to over-fitting to the training data and is to be avoided. The maximum accuracy on the validation set should be a reasonable guide to the accuracy achievable by the neural network in practice.

There was carried out the training as described above for the cases where the number of neurons in the hidden layer was, respectively, 10, 20, 30 and 40. Note that because the starting weights (and biases) are chosen randomly, one can get different results each time the training is carried out for the same number of neurons in the hidden layer (because, for example, convergence can be to different local minima). The following results should be considered to be representative. There was included the root mean squared error in square brackets.

Number of Hidden Neurons=10.

Network is 66.36% correct on training data at iteration 2000 [0.580].

Network is 55.34% correct on all validation data at iteration 2000 [0.668].

Network is 55.21% correct on fully observed validation data at iteration 2000 [0.669].

Network is 73.94% correct on training data at iteration 10000 [0.511].

Network is 60.58% correct on all validation data at iteration 10000 [0.628].

Network is 73.96% correct on fully observed validation data at iteration 10000 [0.510].

Network is 80.04% correct on training data at iteration 20000 [0.447].

Network is 58.64% correct on all validation data at iteration 20000 [0.643].

Network is 68.75% correct on fully observed validation data at iteration 20000 [0.559].

Network is 87.43% correct on training data at iteration 40000 [0.355].

Network is 56.70% correct on all validation data at iteration 40000 [0.658].

Network is 70.83% correct on fully observed validation data at iteration 40000 [0.540].

Network is 91.13% correct on training data at iteration 60000 [0.298].

Network is 55.73% correct on all validation data at iteration 60000 [0.665].

Network is 67.71% correct on fully observed validation data at iteration 60000 [0.568].

Network is 94.09% correct on training data at iteration 80000 [0.243].

Network is 54.56% correct on all validation data at iteration 80000 [0.674].

Network is 66.67% correct on fully observed validation data at iteration 80000 [0.577].

Network is 95.56% correct on training data at iteration 100000 [0.211].

Network is 54.17% correct on all validation data at iteration 100000 [0.677].

Network is 67.71% correct on fully observed validation data at iteration 100000 [0.568].

Number of Hidden Neurons=20.

Network is 68.58% correct on training data at iteration 2000 [0.561].

Network is 57.86% correct on all validation data at iteration 2000 [0.649].

Network is 63.54% correct on fully observed validation data at iteration 2000 [0.604].

Network is 79.30% correct on training data at iteration 10000 [0.455].

Network is 61.75% correct on all validation data at iteration 10000 [0.618].

Network is 80.21% correct on fully observed validation data at iteration 10000 [0.445].

Network is 87.43% correct on training data at iteration 20000 [0.355].

Network is 58.45% correct on all validation data at iteration 20000 [0.645].

Network is 77.08% correct on fully observed validation data at iteration 20000 [0.479].

Network is 93.72% correct on training data at iteration 40000 [0.251].

Network is 58.25% correct on all validation data at iteration 40000 [0.646].

Network is 76.04% correct on fully observed validation data at iteration 40000 [0.489].

Network is 95.75% correct on training data at iteration 60000 [0.206].

Network is 57.48% correct on all validation data at iteration 60000 [0.652].

Network is 76.04% correct on fully observed validation data at iteration 60000 [0.489].

Network is 97.41% correct on training data at iteration 80000 [0.161].

Network is 55.15% correct on all validation data at iteration 80000 [0.670].

Network is 75.00% correct on fully observed validation data at iteration 80000 [0.500].

Network is 97.97% correct on training data at iteration 100000 [0.143].

Network is 56.70% correct on all validation data at iteration 100000 [0.658].

Network is 77.08% correct on fully observed validation data at iteration 100000 [0.479].

Number of Hidden Neurons=30.

Network is 69.50% correct on training data at iteration 2000 [0.552].

Network is 60.78% correct on all validation data at iteration 2000 [0.626].

Network is 67.71% correct on fully observed validation data at iteration 2000 [0.568].

Network is 79.30% correct on training data at iteration 10000 [0.455].

Network is 61.75% correct on all validation data at iteration 10000 [0.618].

Network is 72.92% correct on fully observed validation data at iteration 10000 [0.520].

Network is 88.17% correct on training data at iteration 20000 [0.344].

Network is 59.42% correct on all validation data at iteration 20000 [0.637].

Network is 81.25% correct on fully observed validation data at iteration 20000 [0.433].

Network is 94.09% correct on training data at iteration 40000 [0.243].

Network is 58.25% correct on all validation data at iteration 40000 [0.646].

Network is 73.96% correct on fully observed validation data at iteration 40000 [0.510].

Network is 96.86% correct on training data at iteration 60000 [0.177].

Network is 56.89% correct on all validation data at iteration 60000 [0.657].

Network is 72.92% correct on fully observed validation data at iteration 60000 [0.520].

Network is 97.60% correct on training data at iteration 80000 [0.155].

Network is 56.31% correct on all validation data at iteration 80000 [0.661].

Network is 73.96% correct on fully observed validation data at iteration 80000 [0.510].

Network is 98.71% correct on training data at iteration 100000 [0.114].

Network is 55.15% correct on all validation data at iteration 100000 [0.670].

Network is 68.75% correct on fully observed validation data at iteration 100000 [0.559].

Number of Hidden Neurons=40.

Network is 71.72% correct on training data at iteration 2000 [0.532].

Network is 60.19% correct on all validation data at iteration 2000 [0.631].

Network is 71.88% correct on fully observed validation data at iteration 2000 [0.530].

Network is 80.59% correct on training data at iteration 10000 [0.441].

Network is 61.36% correct on all validation data at iteration 10000 [0.622].

Network is 80.21% correct on fully observed validation data at iteration 10000 [0.445].

Network is 89.65% correct on training data at iteration 20000 [0.322].

Network is 59.61% correct on all validation data at iteration 20000 [0.636].

Network is 78.13% correct on fully observed validation data at iteration 20000 [0.468].

Network is 95.01% correct on training data at iteration 40000 [0.223].

Network is 60.00% correct on all validation data at iteration 40000 [0.632].

Network is 80.21% correct on fully observed validation data at iteration 40000 [0.445].

Network is 97.04% correct on training data at iteration 60000 [0.172].

Network is 60.58% correct on all validation data at iteration 60000 [0.628].

Network is 78.13% correct on fully observed validation data at iteration 60000 [0.468].

Network is 98.15% correct on training data at iteration 80000 [0.136].

Network is 59.61% correct on all validation data at iteration 80000 [0.636].

Network is 77.08% correct on fully observed validation data at iteration 80000 [0.479].

Network is 99.08% correct on training data at iteration 100000 [0.096].

Network is 58.45% correct on all validation data at iteration 100000 [0.645].

Network is 76.04% correct on fully observed validation data at iteration 100000 [0.489].

Summary Results (One Hidden Layer):

With 10 hidden neurons, maximum accuracy on the set of fully observed validation samples was 70.83%.

With 20 hidden neurons, maximum accuracy on the set of fully observed validation samples was 80.21%.

With 30 hidden neurons, maximum accuracy on the set of fully observed validation samples was 81.25%.

With 40 hidden neurons, maximum accuracy on the set of fully observed validation samples was 80.21%.

Note that the maximum accuracy achieved on the set of all validation data was 61.75% (with 30 hidden neurons).

We also implemented feed forward neural networks of the type described earlier but with two or more hidden layers of neurons. We carried out the same type of training as before, but with neural networks of 2, 3 and 4 hidden layers and with the number of neurons per hidden layer set Successively at 5, 10, 15 and 20. As before, the starting weights (and biases) were chosen randomly, so that the results should be considered to be representative. As before, the root mean squared error is included in square brackets.

Number of hidden layers=2.

Number of neurons in first hidden layer=5.

Number of neurons in second hidden layer=5.

Network is 61.18% correct on training data at iteration 2000 [0.623].

Network is 52.04% correct on all validation data at iteration 2000 [0.693].

Network is 43.75% correct on fully observed validation data at iteration 2000 [0.750].

Network is 72.46% correct on training data at iteration 10000 [0.525].

Network is 61.36% correct on all validation data at iteration 10000 [0.622].

Network is 69.79% correct on fully observed validation data at iteration 10000 [0.550].

Network is 78.00% correct on training data at iteration 20000 [0.469].

Network is 60.58% correct on all validation data at iteration 20000 [0.628].

Network is 68.75% correct on fully observed validation data at iteration 20000 [0.559].

Network is 79.85% correct on training data at iteration 40000 [0.449].

Network is 59.42% correct on all validation data at iteration 40000 [0.637].

Network is 65.63% correct on fully observed validation data at iteration 40000 [0.586].

Network is 80.78% correct on training data at iteration 60000 [0.438].

Network is 59.81% correct on all validation data at iteration 60000 [0.634].

Network is 66.67% correct on fully observed validation data at iteration 60000 [0.577].

Network is 81.70% correct on training data at iteration 80000 [0.428].

Network is 60.19% correct on all validation data at iteration 80000 [0.631].

Network is 70.83% correct on fully observed validation data at iteration 80000 [0.540].

Network is 83.55% correct on training data at iteration 100000 [0.406].

Network is 60.00% correct on all validation data at iteration 100000 [0.632].

Network is 72.92% correct on fully observed validation data at iteration 100000 [0.520].

Number of Hidden Layers=2.

Number of neurons in first hidden layer=10.

Number of neurons in second hidden layer=10.

Network is 62.48% correct on training data at iteration 2000 [0.613].

Network is 51.65% correct on all validation data at iteration 2000 [0.695].

Network is 43.75% correct on fully observed validation data at iteration 2000 [0.750].

Network is 74.31% correct on training data at iteration 10000 [0.507].

Network is 60.97% correct on all validation data at iteration 10000 [0.625].

Network is 72.92% correct on fully observed validation data at iteration 10000 [0.520].

Network is 80.78% correct on training data at iteration 20000 [0.438].

Network is 58.45% correct on all validation data at iteration 20000 [0.645].

Network is 73.96% correct on fully observed validation data at iteration 20000 [0.510].

Network is 90.02% correct on training data at iteration 40000 [0.316].

Network is 53.20% correct on all validation data at iteration 40000 [0.684].

Network is 60.42% correct on fully observed validation data at iteration 40000 [0.629].

Network is 92.05% correct on training data at iteration 60000 [0.282].

Network is 55.15% correct on all validation data at iteration 60000 [0.670].

Network is 61.46% correct on fully observed validation data at iteration 60000 [0.621].

Network is 93.72% correct on training data at iteration 80000 [0.251].

Network is 56.12% correct on all validation data at iteration 80000 [0.662].

Network is 61.46% correct on fully observed validation data at iteration 80000 [0.621].

Network is 95.01% correct on training data at iteration 100000 [0.223].

Network is 53.79% correct on all validation data at iteration 100000 [0.680].

Network is 56.25% correct on fully observed validation data at iteration 100000 [0.661].

Number of hidden layers=2.

Number of neurons in first hidden layer=15.

Number of neurons in second hidden layer=15.

Network is 63.59% correct on training data at iteration 2000 [0.603].

Network is 54.37% correct on all validation data at iteration 2000 [0.676].

Network is 50.00% correct on fully observed validation data at iteration 2000 [0.707].

Network is 74.12% correct on training data at iteration 10000 [0.509].

Network is 62.33% correct on all validation data at iteration 10000 [0.614].

Network is 75.00% correct on fully observed validation data at iteration 10000 [0.500].

Network is 87.06% correct on training data at iteration 20000 [0.360].

Network is 59.22% correct on all validation data at iteration 20000 [0.639].

Network is 73.96% correct on fully observed validation data at iteration 20000 [0.510].

Network is 94.45% correct on training data at iteration 40000 [0.235].

Network is 58.25% correct on all validation data at iteration 40000 [0.646].

Network is 75.00% correct on fully observed validation data at iteration 40000 [0.500].

Network is 95.75% correct on training data at iteration 60000 [0.206].

Network is 58.83% correct on all validation data at iteration 60000 [0.642].

Network is 76.04% correct on fully observed validation data at iteration 60000 [0.489].

Network is 95.75% correct on training data at iteration 80000 [0.206].

Network is 59.22% correct on all validation data at iteration 80000 [0.639].

Network is 77.08% correct on fully observed validation data at iteration 80000 [0.479].

Network is 95.75% correct on training data at iteration 100000 [0.206].

Network is 59.61% correct on all validation data at iteration 100000 [0.636].

Network is 78.13% correct on fully observed validation data at iteration 100000 [0.468].

Number of hidden layers=2.

Number of neurons in first hidden layer=20.

Number of neurons in second hidden layer=20.

Network is 62.85% correct on training data at iteration 2000 [0.610].

Network is 54.76% correct on all validation data at iteration 2000 [0.673].

Network is 52.08% correct on fully observed validation data at iteration 2000 [0.692].

Network is 75.23% correct on training data at iteration 10000 [0.498].

Network is 61.94% correct on all validation data at iteration 10000 [0.617].

Network is 75.00% correct on fully observed validation data at iteration 10000 [0.500].

Network is 86.32% correct on training data at iteration 20000 [0.370].

Network is 57.86% correct on all validation data at iteration 20000 [0.649].

Network is 75.00% correct on fully observed validation data at iteration 20000 [0.500].

Network is 95.19% correct on training data at iteration 40000 [0.219].

Network is 57.09% correct on all validation data at iteration 40000 [0.655].

Network is 69.79% correct on fully observed validation data at iteration 40000 [0.550].

Network is 96.67% correct on training data at iteration 60000 [0.182].

Network is 58.64% correct on all validation data at iteration 60000 [0.643].

Network is 70.83% correct on fully observed validation data at iteration 60000 [0.540].

Network is 97.04% correct on training data at iteration 80000 [0.172].

Network is 59.03% correct on all validation data at iteration 80000 [0.640].

Network is 71.88% correct on fully observed validation data at iteration 80000 [0.530].

Network is 97.04% correct on training data at iteration 100000 [0.172].

Network is 58.06% correct on all validation data at iteration 100000 [0.648].

Network is 71.88% correct on fully observed validation data at iteration 100000 [0.530].

Number of Hidden Layers=3.

Number of neurons in first hidden layer is 5.

Number of neurons in second hidden layer is 5.

Number of neurons in third hidden layer is 5.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 54.16% correct on training data at iteration 10000 [0.677].

Network is 50.29% correct on all validation data at iteration 10000 [0.705].

Network is 48.96% correct on fully observed validation data at iteration 10000 [0.714].

Network is 69.69% correct on training data at iteration 20000 [0.551].

Network is 61.55% correct on all validation data at iteration 20000 [0.620].

Network is 69.79% correct on fully observed validation data at iteration 20000 [0.550].

Network is 82.07% correct on training data at iteration 40000 [0.423].

Network is 58.45% correct on all validation data at iteration 40000 [0.645].

Network is 67.71% correct on fully observed validation data at iteration 40000 [0.568].

Network is 85.95% correct on training data at iteration 60000 [0.375].

Network is 57.09% correct on all validation data at iteration 60000 [0.655].

Network is 67.71% correct on fully observed validation data at iteration 60000 [0.568].

Network is 88.54% correct on training data at iteration 80000 [0.339].

Network is 55.73% correct on all validation data at iteration 80000 [0.665].

Network is 60.42% correct on fully observed validation data at iteration 80000 [0.629].

Network is 89.46% correct on training data at iteration 100000 [0.325].

Network is 55.73% correct on all validation data at iteration 100000 [0.665].

Network is 59.38% correct on fully observed validation data at iteration 100000 [0.637].

Number of hidden layers=3.

Number of neurons in first hidden layer is 10.

Number of neurons in second hidden layer is 10.

Number of neurons in third hidden layer is 10.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 72.83% correct on training data at iteration 10000 [0.521].

Network is 57.67% correct on all validation data at iteration 10000 [0.651].

Network is 69.79% correct on fully observed validation data at iteration 10000 [0.550].

Network is 82.81% correct on training data at iteration 20000 [0.415].

Network is 55.92% correct on all validation data at iteration 20000 [0.664].

Network is 70.83% correct on fully observed validation data at iteration 20000 [0.540].

Network is 94.64% correct on training data at iteration 40000 [0.232].

Network is 56.70% correct on all validation data at iteration 40000 [0.658].

Network is 78.13% correct on fully observed validation data at iteration 40000 [0.468].

Network is 95.19% correct on training data at iteration 60000 [0.219].

Network is 58.06% correct on all validation data at iteration 60000 [0.648].

Network is 77.08% correct on fully observed validation data at iteration 60000 [0.479].

Network is 95.56% correct on training data at iteration 80000 [0.211].

Network is 58.83% correct on all validation data at iteration 80000 [0.642].

Network is 77.08% correct on fully observed validation data at iteration 80000 [0.479].

Network is 95.56% correct on training data at iteration 100000 [0.211].

Network is 58.45% correct on all validation data at iteration 100000 [0.645].

Network is 77.08% correct on fully observed validation data at iteration 100000 [0.479].

Number of Hidden Layers=3.

Number of neurons in first hidden layer is 15.

Number of neurons in second hidden layer is 15.

Number of neurons in third hidden layer is 15.

Network is 62.66% correct on training data at iteration 2000 [0.611].

Network is 55.53% correct on all validation data at iteration 2000 [0.667].

Network is 47.92% correct on fully observed validation data at iteration 2000 [0.722].

Network is 73.57% correct on training data at iteration 10000 [0.514].

Network is 60.00% correct on all validation data at iteration 10000 [0.632].

Network is 71.88% correct on fully observed validation data at iteration 10000 [0.530].

Network is 87.25% correct on training data at iteration 20000 [0.357].

Network is 60.19% correct on all validation data at iteration 20000 [0.631].

Network is 70.83% correct on fully observed validation data at iteration 20000 [0.540].

Network is 96.12% correct on training data at iteration 40000 [0.197].

Network is 55.53% correct on all validation data at iteration 40000 [0.667].

Network is 65.63% correct on fully observed validation data at iteration 40000 [0.586].

Network is 96.30% correct on training data at iteration 60000 [0.192].

Network is 55.15% correct on all validation data at iteration 60000 [0.670].

Network is 64.58% correct on fully observed validation data at iteration 60000 [0.595].

Network is 96.30% correct on training data at iteration 80000 [0.192].

Network is 55.92% correct on all validation data at iteration 80000 [0.664].

Network is 65.63% correct on fully observed validation data at iteration 80000 [0.586].

Network is 96.30% correct on training data at iteration 100000 [0.192].

Network is 55.53% correct on all validation data at iteration 100000 [0.667].

Network is 65.63% correct on fully observed validation data at iteration 100000 [0.586].

Number of Hidden Layers=3.

Number of neurons in first hidden layer is 20.

Number of neurons in second hidden layer is 20.

Number of neurons in third hidden layer is 20.

Network is 62.85% correct on training data at iteration 2000 [0.610].

Network is 54.76% correct on all validation data at iteration 2000 [0.673].

Network is 53.13% correct on fully observed validation data at iteration 2000 [0.685].

Network is 76.52% correct on training data at iteration 10000 [0.485].

Network is 63.30% correct on all validation data at iteration 10000 [0.606].

Network is 76.04% correct on fully observed validation data at iteration 10000 [0.489].

Network is 90.76% correct on training data at iteration 20000 [0.304].

Network is 57.28% correct on all validation data at iteration 20000 [0.654].

Network is 77.08% correct on fully observed validation data at iteration 20000 [0.479].

Network is 96.12% correct on training data at iteration 40000 [0.197].

Network is 56.89% correct on all validation data at iteration 40000 [0.657].

Network is 71.88% correct on fully observed validation data at iteration 40000 [0.530].

Network is 96.30% correct on training data at iteration 60000 [0.192].

Network is 55.34% correct on all validation data at iteration 60000 [0.668].

Network is 69.79% correct on fully observed validation data at iteration 60000 [0.550].

Network is 96.49% correct on training data at iteration 80000 [0.187].

Network is 55.53% correct on all validation data at iteration 80000 [0.667].

Network is 70.83% correct on fully observed validation data at iteration 80000 [0.540].

Network is 96.49% correct on training data at iteration 100000 [0.187].

Network is 54.95% correct on all validation data at iteration 100000 [0.671].

Network is 70.83% correct on fully observed validation data at iteration 100000 [0.540].

Number of Hidden Layers=4.

Number of neurons in first hidden layer=5.

Number of neurons in second hidden layer=5.

Number of neurons in third hidden layer=5.

Number of neurons in fourth hidden layer=5.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 54.16% correct on training data at iteration 10000 [0.677].

Network is 50.29% correct on all validation data at iteration 10000 [0.705].

Network is 48.96% correct on fully observed validation data at iteration 10000 [0.714].

Network is 54.16% correct on training data at iteration 20000 [0.677].

Network is 50.29% correct on all validation data at iteration 20000 [0.705].

Network is 48.96% correct on fully observed validation data at iteration 20000 [0.714].

Network is 62.48% correct on training data at iteration 40000 [0.613].

Network is 53.98% correct on all validation data at iteration 40000 [0.678].

Network is 48.96% correct on fully observed validation data at iteration 40000 [0.714].

Network is 80.78% correct on training data at iteration 60000 [0.438].

Network is 61.55% correct on all validation data at iteration 60000 [0.620].

Network is 77.08% correct on fully observed validation data at iteration 60000 [0.479].

Network is 81.89% correct on training data at iteration 80000 [0.426].

Network is 60.39% correct on all validation data at iteration 80000 [0.629].

Network is 77.08% correct on fully observed validation data at iteration 80000 [0.479].

Network is 84.10% correct on training data at iteration 100000 [0.399].

Network is 59.81% correct on all validation data at iteration 100000 [0.634].

Network is 76.04% correct on fully observed validation data at iteration 100000 [0.489].

Number of Hidden Layers=4.

Number of neurons in first hidden layer=10.

Number of neurons in second hidden layer=10.

Number of neurons in third hidden layer=10.

Number of neurons in fourth hidden layer=10.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 54.16% correct on training data at iteration 10000 [0.677].

Network is 50.29% correct on all validation data at iteration 10000 [0.705].

Network is 48.96% correct on fully observed validation data at iteration 10000 [0.714].

Network is 54.16% correct on training data at iteration 20000 [0.677].

Network is 50.29% correct on all validation data at iteration 20000 [0.705].

Network is 48.96% correct on fully observed validation data at iteration 20000 [0.714].

Network is 84.47% correct on training data at iteration 40000 [0.394].

Network is 57.48% correct on all validation data at iteration 40000 [0.652].

Network is 77.08% correct on fully observed validation data at iteration 40000 [0.479].

Network is 94.45% correct on training data at iteration 60000 [0.235].

Network is 53.40% correct on all validation data at iteration 60000 [0.683].

Network is 70.83% correct on fully observed validation data at iteration 60000 [0.540].

Network is 94.82% correct on training data at iteration 80000 [0.227].

Network is 52.82% correct on all validation data at iteration 80000 [0.687].

Network is 67.71% correct on fully observed validation data at iteration 80000 [0.568].

Network is 94.82% correct on training data at iteration 100000 [0.227].

Network is 52.82% correct on all validation data at iteration 100000 [0.687].

Network is 68.75% correct on fully observed validation data at iteration 100000 [0.559].

Number of Hidden Layers=4.

Number of neurons in first hidden layer=15.

Number of neurons in second hidden layer=15.

Number of neurons in third hidden layer=15.

Number of neurons in fourth hidden layer=15.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 62.48% correct on training data at iteration 10000 [0.613].

Network is 52.82% correct on all validation data at iteration 10000 [0.687].

Network is 42.71% correct on fully observed validation data at iteration 10000 [0.757].

Network is 77.26% correct on training data at iteration 20000 [0.477].

Network is 57.86% correct on all validation data at iteration 20000 [0.649].

Network is 69.79% correct on fully observed validation data at iteration 20000 [0.550].

Network is 94.09% correct on training data at iteration 40000 [0.243].

Network is 56.70% correct on all validation data at iteration 40000 [0.658].

Network is 68.75% correct on fully observed validation data at iteration 40000 [0.559].

Network is 95.56% correct on training data at iteration 60000 [0.211].

Network is 55.92% correct on all validation data at iteration 60000 [0.664].

Network is 65.63% correct on fully observed validation data at iteration 60000 [0.586].

Network is 95.56% correct on training data at iteration 80000 [0.211].

Network is 55.34% correct on all validation data at iteration 80000 [0.668].

Network is 64.58% correct on fully observed validation data at iteration 80000 [0.595].

Network is 95.56% correct on training data at iteration 100000 [0.211].

Network is 55.73% correct on all validation data at iteration 100000 [0.665].

Network is 64.58% correct on fully observed validation data at iteration 100000 [0.595].

Number of Hidden Layers=4.

Number of neurons in first hidden layer=20.

Number of neurons in second hidden layer=20.

Number of neurons in third hidden layer=20.

Number of neurons in fourth hidden layer=20.

Network is 54.16% correct on training data at iteration 2000 [0.677].

Network is 50.29% correct on all validation data at iteration 2000 [0.705].

Network is 48.96% correct on fully observed validation data at iteration 2000 [0.714].

Network is 66.73% correct on training data at iteration 10000 [0.577].

Network is 57.67% correct on all validation data at iteration 10000 [0.651].

Network is 65.63% correct on fully observed validation data at iteration 10000 [0.586].

Network is 85.03% correct on training data at iteration 20000 [0.387].

Network is 60.78% correct on all validation data at iteration 20000 [0.626].

Network is 73.96% correct on fully observed validation data at iteration 20000 [0.510].

Network is 96.30% correct on training data at iteration 40000 [0.192].

Network is 58.25% correct on all validation data at iteration 40000 [0.646].

Network is 69.79% correct on fully observed validation data at iteration 40000 [0.550].

Network is 96.30% correct on training data at iteration 60000 [0.192].

Network is 59.42% correct on all validation data at iteration 60000 [0.637].

Network is 68.75% correct on fully observed validation data at iteration 60000 [0.559].

Network is 96.30% correct on training data at iteration 80000 [0.192].

Network is 59.22% correct on all validation data at iteration 80000 [0.639].

Network is 66.67% correct on fully observed validation data at iteration 80000 [0.577].

Network is 96.30% correct on training data at iteration 100000 [0.192].

Network is 59.03% correct on all validation data at iteration 100000 [0.640].

Network is 66.67% correct on fully observed validation data at iteration 100000 [0.577].

Summary Results (More than One Hidden Layer):

2 Hidden Layers:

With 5 neurons per hidden layer, maximum accuracy on the set of fully observed validation samples was 72.92%.

With 10 neurons per hidden layer, maximum accuracy on the set of fully observed validation samples was 73.96%.

With 15 neurons per hidden layer, maximum accuracy on the set of fully observed validation samples was 78.13%.

With 20 neurons per hidden layer, maximum accuracy on the set of fully observed validation samples was 75.00%.

3 Hidden Layers:

With 5 neurons per hidden layer, maximum accuracy on the set of fully observed validation samples was 69.79%.

With 10 neurons per hidden layer, maximum accuracy on the set of fully observed validation samples was 78.13%.

With 15 neurons per hidden layer, maximum accuracy on the set of fully observed validation samples was 71.88%.

With 20 neurons per hidden layer, maximum accuracy on the set of fully observed validation samples was 77.08%.

4 Hidden Layers:

With 5 neurons per hidden layer, maximum accuracy on the set of fully observed validation samples was 77.08%.

With 10 neurons per hidden layer, maximum accuracy on the set of fully observed validation samples was 77.08%.

With 15 neurons per hidden layer, maximum accuracy on the set of fully observed validation samples was 69.79%.

With 20 neurons per hidden layer, maximum accuracy on the set of fully observed validation samples was 73.96%.

Note that the maximum accuracy achieved on the set of all validation data was 63.30% (with 3 hidden neurons and 20 neurons per hidden layer).

These results suggest that greater accuracy is achievable with one hidden layer of neurons than with two, three or four hidden layers, although accuracy with two, three or four hidden layers is not far below that with one hidden layer. Further testing with different starting weights (and biases) or with different neural network architectures may alter this conclusion. Optimization of the weights (and biases) of a given neural network will also play an important role, as will optimization of the neural network architecture. In the above analysis, we only sampled a few neural network architectures. For example, one could have had different numbers of neurons in different hidden layers.

Appendix B—Optimizing the Neural Network Architecture

A Global Training Algorithm

The Global Optimization Algorithm is a coarse-grained global optimization technique. The training algorithm described in the section Improving the Efficiency of Training is a fine-grained local optimization technique. It employs gradients calculated by the back propagation algorithm described in the section The Mathematics of Back Propagation, but differs from the simple gradient descent training algorithm described in that section. Note that the gradient descent training algorithm of that section is also commonly referred to as back propagation. The Global Optimization Algorithm and the training algorithm described in the section Improving the Efficiency of Training can be combined to yield a global technique for carrying out training in a neural network. This global technique will be fine-grained, at least when it counts.

The first and simplest way is to use the Global Optimization Algorithm to minimize the error function implied by the neural network and the training set, and then to use the vector determining the resulting minimum as the starting point for the training algorithm described in the section Improving the Efficiency of Training. The resulting local minimum is then taken to be the global minimum.

A second way of combining the two techniques is to again use the Global Optimization Algorithm to minimize the error function implied by the neural network and the training set, but to incorporate the following modification. At each iteration, the position vector for each agent is updated not once, but twice. The first update is as described in the specified algorithm. After this first update, the position vector is used as the starting point for the training algorithm described in the section Improving the Efficiency of Training, and the position vector is then updated (a second time) to be the position vector for the resulting local minimum. The rest of the algorithm remains unchanged.

Thus we get a global training algorithm for a given neural network equipped with a training set. This global training algorithm combines the Global Optimization Algorithm and the training algorithm described in the section Improving the Efficiency of Training which, as we said before, itself employs the back propagation algorithm for calculating gradients. The global training algorithm does not employ the gradient descent training algorithm described in the section The Mathematics of Back Propagation.

Optimizing the Neural Network Architecture

One can optimize over a range of neural network architectures by doing a minimization using the discrete version of the Global Optimization Algorithm where the objective function is taken to be the global minimum (depending on the given training set) as a function of the neural network architecture, this global minimum being determined by the global training algorithm we have just described. Thus this optimization employs the Global Optimization Algorithm twice, once in its modified continuous version and once in its discrete version, as well as the training algorithm described in the section Improving the Efficiency of Training. Again, the training algorithm employed is different from the gradient descent training algorithm described in the section The Mathematics of Back Propagation.

Appendix C—Overview of Neural Networks and their Capabilities for Use in Detecting and Assessing Problem Gamblers The following theorem is an adaptation to neural networks to illustrate the capabilities of neural networks, as part of a Supervised Machine Learning process, in detecting and identifying Problemed Gambling and addictive behavior.

Replication Theorem

Any continuous function $f$ from a compact (that is, a closed and bounded)

subset of $R^n$ into $R^m$ can be exactly replicated by a feed forward neural network with three layers, the first layer consisting of n input neurons, the second (hidden) layer consisting of 2n+1 neurons and the third (output) layer consisting of m output neurons.

Let $$x = \begin{pmatrix} x^1 \\ \vdots \\ x^n \end{pmatrix}$$

$\in R^n$ be the vector of inputs, so that, for 1=1, . . . , n, $x_j$ is the value passed to the $j^{th}$ input neuron.

If $h_k$, for $k \in \{1, \ldots, 2n+1\}$, is the output value of the $k^{th}$ hidden neuron, the proof of the theorem shows that $h_k$ is of the form $$\sum_{j=1}^{n} \beta^k \psi(xj + k\varepsilon) + k_R$$

Where β is a real constant, ψ is a continuous real-valued monotonically increasing function, β and ψ are independent of $f$, but do depend on n, and ε is a positive rational number which can be chosen to be arbitrarily small.

If $y_1$, for $i \in \{1, \ldots, m\}$, is the output value of the $i^{th}$ output neuron, the proof of the theorem shows that $y_1$ is of the form $$\sum_{k=1}^{2n+1} \psi_i(h_k)$$

Where $\psi_1, \ldots, \psi_m$ are continuous real-valued functions which depend on $f$ and ε.

Thus the theorem asserts that $$f(x) = \begin{pmatrix} \sum_{k=1}^{2n+1} \psi_1\left(\sum_{j=1}^{n} \beta^k \psi(x_j + k\varepsilon) + k\right) \\ \vdots \\ \sum_{k=1}^{2n+1} \psi_m\left(\sum_{j=1}^{n} \beta^k \psi(x_j + k\varepsilon) + k\right) \end{pmatrix}$$

For all $$n = \begin{pmatrix} x^1 \\ \vdots \\ x^n \end{pmatrix}$$

$\in R^n$.

Note that the proof of the theorem is not constructive. It does not tell us how to find the three-layered neural network that replicates the function $f$. No specific examples of the function and the constant ε are known. Nor are any examples of the functions $\psi_1, \ldots, \psi_m$ known. Note also that the theorem is false if the function $f$ is taken to be a random function (as opposed to a deterministic function). Although the theorem has no practical value, it does assure us that the search for approximations of functions by neural networks is soundly based, at least in theory.

We can give another theorem illustrating the theoretical capabilities of neural networks.

Let A be a compact subset of $R^n$. Suppose $f$ is a function from A into $R^m$ $$\text{Then} = \begin{pmatrix} f^1 \\ \vdots \\ f^m \end{pmatrix},$$

where $f_1, \ldots, f_m$ are functions from A into R.

Now $f$ is said to be an $L_2$ function if $f_1, \ldots, f_m$ are square integrable, that is, if $$\int_A |f_k(x)|^2 dx \text{ exists for } =1, \ldots, m.$$

For $$z = \begin{pmatrix} z^1 \\ \vdots \\ z^n \end{pmatrix}$$

we define $$\|z\| \stackrel{df}{=} \sqrt{\sum_{k=1}^{m} z_k^2}.$$

Approximation Theorem

Let ε>0 and suppose $f: A \rightarrow R^m$ is an $L_2$ function. Then there exists a three-layered feed forward neural network, with logistic activation functions for each neuron of the second (hidden) layer and with identity activation functions for each neuron of the third (output) layer, such that $$\int_A \|f(x)-g(x)\|^2 dx<\varepsilon,$$

Where g(x) is the output vector calculated by the neural network as a function of the input vector $\in R^n$; that is, the neural network approximates the function $f$ to within ε in the mean-squared sense.

Let us be more specific about the neural network's output function g.

There are n input neurons and m output neurons.

Let N be the number of neurons in the hidden layer.

Let $w_{ij}^1$ be the weight associated with the connection from the $i^{th}$ input neuron to the $j^{th}$ neuron of the hidden layer. Let $w_{jk}^2$ be the weight associated with the connection from the $j^{th}$ neuron of the hidden layer to the $k^{th}$ neuron of the output layer.

Let $$x=\begin{pmatrix} x_1 \\ \vdots \\ x_n \end{pmatrix}$$

$\in IR^n$ be the input vector. Then, for =1, . . . , N, $h_j$, the output value of the $j^{th}$ neuron of the hidden layer is of the form $$s\left(\sum_{i=1}^{n} w_{ij}^1 x_i\right),$$

Where $$s(t) \stackrel{df}{=} \frac{1}{1+e^{-s}}$$

is the logistic function.

For k=1, . . . , m, $y_k$, the output value of the $k^{th}$ output neuron is of the form $$\sum_{j=1}^{N} w_{jk}^2 h_j$$

Then g(x), the neural network's calculated output, is $$\begin{pmatrix} y_1 \\ \vdots \\ y_m \end{pmatrix}=\begin{pmatrix} \sum_{j=1}^{N} w_{ji}^2 7\left(\sum_{i=1}^{n} w_{ij}^1 x_i\right) \\ \sum_{j=1}^{N} w_{jm}^2 7\left(\sum_{i=1}^{n} w_{ij}^1 x_i\right) \end{pmatrix}.$$

Note that g depends on N and on the weights of $w_{ij}^1$ and $w_{jk}^2$.

We can make some general observations.

First, the space of $L_2$ functions includes every function that could ever arise in a practical problem. In particular, it includes all continuous functions and all piecewise linear functions.

Second, although the theorem shows that three layers (with one hidden layer) are always enough, in many problems the number of neurons in the hidden layer may be impractically large, whereas a practically feasible solution may be possible using more than three layers (more than one hidden layer).

Third, although the theorem guarantees the existence of a suitable approximating neural network with appropriate values for the weights, there is no guarantee that that these weights can be found by any known training algorithm.

Fourth, the theorem is false if the function $f$ is taken to be random.

Again, the theorem is reassuring in a theoretical sense, but does not necessarily provide practical solutions.

The Mathematics of Back Propagation

Let $f:IR^n \rightarrow IR^m$ be an unknown function (deterministic or random) that some given feed forward neural network is intended to approximate. We assume that the neural network has M layers of neurons including the input and output layers, so that M≥2. We suppose that there are $N_\alpha$ neurons in layer α, for $\alpha \in \{1, \ldots, M\}$. Thus the total number of neurons in the neural network is $\Sigma_{\alpha=1}^{M} N_\alpha$. Note that $N_1$=n and $N_M$=m.

To simplify the treatment, we will assume that there are no biases. Let $w_{ij}^\alpha$ the weight associated with the connection from the $i^{th}$ input neuron of layer to the $i^{th}$ neuron of layer α+1. We let W be the vector of all weights:

$$W \stackrel{df}{=} (w_{ij}^\alpha)_{\substack{1\le\alpha\le M-1 \\ 1\le i\le N_\alpha \\ 1\le j\le N_{\alpha+1}}}$$

Let the input vector be $$X=\begin{pmatrix} x^1 \\ \vdots \\ x^n \end{pmatrix}$$

$\in R^n$.

We wish to calculate the neural network's output using a forward pass with X providing the input and with the weights contained in W fixed. We will take each activation (or transfer) function to be the logistic function $$s(t) \stackrel{df}{=} \frac{1}{1+e^{-t}}$$

Note that the argument which follows can be easily modified if other (infinitely) differentiable activation functions are employed. In particular, one could take the activation functions associated with the output neurons to be the identity function as used in the Approximation Theorem discussed earlier.

The forward pass:

for $i=1$ to $n$ $g_j^1(X, W) \leftarrow X_i$ for $\alpha=2$ to $N$ for $i=1$ to $N_\alpha$ -continued $$g_i^{\alpha}(X, W) \leftarrow s\left(\sum_{i=1}^{N_{\alpha-1}} w_{ii}^{\alpha-1} g_i^{\alpha-1}(X, W)\right).$$

Then the neural network's output (or approximation of the unknown $f(X)$ is $$g(X, W) \stackrel{df}{=} \begin{pmatrix} g_1^M(X, W) \\ \vdots \\ g_m^M(X, W \end{pmatrix} \in R^m$$

Note that this is a function of the input vector X and the weight vector W.

We now suppose that $\{(x_1, y_1), \ldots, (x_k, y_k), \ldots\}$ is an infinite sequence of training examples. We assume that each training example is drawn from the same (unknown) probability distribution and that, for each $k \geq 1$, $x_k \in R^n$ and $y_k = f(x_k) \in R^m$.

We now wish to define the error, of the neural network's approximation of $f$, as a function of both the weight vector W and the given training sequence.

First, for $k \geq 1$, we define $$F_k(W) \stackrel{df}{=} \|y_k - g(x_k, W)\|^2.$$

Where $\| \ldots \|$ is the Euclidean 2-norm on $R^n$ defined earlier.

Note that $F_k(W)$ is the square of the approximation error made by the neural network on the $k^{th}$ sample provided by the training sequence.

We now define $$F(W) \stackrel{df}{=} \lim_{N \to \infty} \frac{1}{N} \sum_{k=1}^{N} F_k(W)$$

One can show that the right hand side of this definition converges almost surely (with probability 1) to the expected value of each $F_k(W)$. $F(W)$ is the mean squared error as a function the weight vector W. Note that $F(W) \geq 0$ because each $F_k(W) \geq 0$.

Note that $F(W)$ also depends on the given training sequence.

Assuming that $F(W)$ is not already zero, our goal is to move the vector W in a direction that ensures that the value of F will be smaller at the new value of W. Assuming that F is differentiable, the direction of maximum decrease is given by $$-\nabla F(W) = -\left(\frac{\partial F}{\partial W_1}, \ldots, \frac{\partial F}{\partial W_0}\right).$$

where we are assuming that W has Q components $$\left(W = \begin{pmatrix} W_1 \\ \vdots \\ W_Q \end{pmatrix}\right).$$

We will show that F is differentiable.

First note that $g(X, W)$ is composed of affine transformations and smooth sigmoid activation functions, so that $g(X, W)$ is a $C^{\infty}$ function of both X and W (all partial derivatives of all orders exist and are continuous) and the limits defining the derivatives of $g(X, W)$ all converge uniformly on compact sets. Then $F_k(W)$ has these same properties because $$F_k = \|f(x_k) - g(x_k, W)\|^2,$$

and $y_k = f(x_k) \in R^m$ is a constant.

We now show that F is differentiable and that $$\nabla F(W) = \lim_{N \to \infty} \frac{1}{N} \sum_{k=1}^{N} \nabla F_k(W)$$

almost surely.

First, let W be fixed and suppose $k \geq 1$.

We define $$G_q(\varepsilon, \delta) \stackrel{df}{=} \frac{1}{\left\lfloor \frac{1}{|\varepsilon|} \right\rfloor} \sum_{k=1}^{\left\lfloor \frac{1}{|\varepsilon|} \right\rfloor} \left(\frac{F_k(W + \delta_{uq}) - F_k(W)}{\delta}\right),$$

For $q \in \{1, \ldots, Q\}$, where $u_q$ is the unit basis vector along the $q^{th}$ coordinate axis of $R^Q$.

$\varepsilon$ and $\delta$ are numbers ranging over a compact neighbourhood U of zero (with zero removed), and $\lfloor - \rfloor$ is the floor function ($\lfloor t \rfloor$ is the largest integer $\leq t$).

Now the limits that define the partial derivatives of $F_k$ all converge uniformly on compact sets in $R^Q$, so that the limit $$\lim_{\delta \to 0} G_q(\varepsilon, \delta) = \frac{1}{\left\lfloor \frac{1}{|\varepsilon|} \right\rfloor} \sum_{k=1}^{\left\lfloor \frac{1}{|\varepsilon|} \right\rfloor} \frac{\partial F_k}{\partial W_q}$$

converges uniformly on U.

Now the random variable $F_k(W)$ is bounded and one can show that this implies that $F_k(W)$ has a well-defined expectation equal to $F(W)$. Thus, for each $\delta \in U$, the limit $$\lim_{\varepsilon \to 0} G_q(\varepsilon, \delta) = \frac{F(W + \delta u_q) - f(W)}{\delta}$$

converges almost surely. Then, by the theory of iterated limits, $$\lim_{\varepsilon \to 0} \lim_{\delta \to 0} G_q(\varepsilon, \delta)$$

and $$\lim_{\delta \to 0} \lim_{\varepsilon \to 0} G_q(\varepsilon, \delta)$$

both exist and are equal almost surely. Thus we have shown that, almost surely, F is a differentiable function and that $$\nabla F(W) = \lim_{N \to \infty} \frac{1}{N} \sum_{k=1}^{N} \nabla F_k(W)$$

We can now proceed to derive the back propagation algorithm. We do this by deriving a formula for calculating $$-\nabla F(W) = -\left(\frac{\partial F}{\partial W_1}, \frac{\partial F}{\partial W_2}, \cdots, \frac{\partial F}{\partial W_Q}\right)$$

by using the given training sequence. Let us consider $$\frac{\partial F}{\partial W_Q},$$

for $q \in \{1, \ldots, Q\}$.

Now, by the results proved above, we have $$\frac{\partial F}{\partial W_q} = \lim_{N\to\infty} \frac{1}{N} \sum_{k=1}^{N} \frac{\partial F_k}{\partial W_q}$$

Now suppose that the component $W_q$ is $W_{ij}^{\alpha}$, for $\alpha \in \{1, \ldots, M-1\}$, $i \in \{1, \ldots, N_\alpha\}$ and $j \in \{1, \ldots, N_{\alpha+1}\}$. Let $k \geq 1$. The chain rule gives $$\frac{\partial F_k}{\partial W_q} = \frac{\partial F_k}{\partial w_{ij}^{\alpha}} = \frac{\partial F_k}{\partial \varphi_{kj}^{\alpha}(W)} \frac{\partial \varphi_{kj}^{\alpha}(W)}{\partial w_{ij}^{\alpha}},$$

$$\text{where } Q_{kj}^{\alpha}(W) \stackrel{df}{=} \sum_{z=1}^{N_\alpha} w_{lj}^{\alpha} \cdot g_l^{\alpha}(x_k, W),$$

because any functional dependence of $F_k(W)$ on $w_{ij}^{\alpha}$ must be via $\in_{ij}^{\alpha}$.

We now define $$\int_j^{\alpha+1}(x_k, W) \stackrel{df}{=} \frac{\partial F_k}{\partial \varphi_{kj}^{\alpha}(W)}.$$

Then we have $$\frac{\partial F_k}{\partial W_q} = \delta_j^{\alpha+1}(x_k, W) \frac{\partial}{\partial w_{ij}^{\alpha}}\left(\sum_{l=1}^{N_\alpha} w_{lj}^{\alpha} g_l^{\alpha}(x_k, W)\right)$$

$$= \delta_j^{\alpha+1}(x_k, W) g_i^{\alpha}(x_k, W).$$

First suppose $\alpha+1$ is the index of a hidden layer of neurons, that is, $\alpha+1<M$.

Then, using the multidimensional chain rule, we get $$\frac{\partial F_k}{\partial g_j^{\alpha+1}(x_k, W)} = \sum_{\lambda=1}^{N_{\alpha+3}} \frac{\partial F_k}{\partial \varphi_{k\lambda}^{\alpha+1}(W)} \frac{\partial \varphi_{k\lambda}^{\alpha+1}(W)}{\partial g_j^{\alpha+1}(x_k, W)}.$$

-continued $$\text{Thus } \delta_j^{\alpha+1}(x_k, W) = \frac{\partial F_k}{\partial g_j^{\alpha+1}(x_k, w)} \frac{\partial g_j^{\alpha+1}(x_k, W)}{\partial \varphi_{kj}^{\alpha}(W)}$$

$$= \sum_{\lambda=1}^{N_{\alpha+3}} \frac{\partial F_k}{\partial \varphi_{k\lambda}^{\alpha+1}(W)} \frac{\partial \varphi_{k\lambda}^{\alpha+1}(W)}{\partial g_j^{\alpha+1}(x_k, W)}$$

$$= \frac{ds}{dt}(\varphi_{kj}^{\alpha}(W)) \sum_{\lambda=1}^{N_{\alpha+2}} \delta_\lambda^{\alpha+2}(x_k, W) w_{j\lambda}^{\alpha+1},$$

$$\text{because } \frac{\partial \varphi_{k\lambda}^{\alpha+1}(W)}{\partial g_j^{\alpha+1}(x_k, W)} = \frac{\partial\left(\sum_{l=1}^{N_{\alpha+1}} w_{l\lambda}^{\alpha+1} g_l^{\alpha+1}(x_k, W)\right)}{\partial g_j^{\alpha+1}(x_k, W)}$$

$$= w_{j\lambda}^{\alpha+1}.$$

$$\text{So, given that } \frac{ds}{dt} = s(t)(1 - s(t)),$$

$$\delta_j^{\alpha+1}(x_k, W) = \left(\sum_{\lambda=1}^{N_{\alpha+2}} \delta_\lambda^{\alpha+2}(x_k, W) w_{j\lambda}^{\alpha+1}\right) s(\varphi_{kj}^{\alpha}(W)(1 - s(\varphi_{kj}^{\alpha}(W))$$

$$= \left(\sum_{\lambda=1}^{N_{\alpha+2}} w_{j\lambda}^{\alpha+1} \delta_\lambda^{\alpha+2}(x_k, W)\right) g_j^{\alpha+1}(x_k, W)(1 - g_j^{\alpha+1}(x_k, W)),$$

Now suppose $\alpha+1=M$.

$$\text{Then } \delta_j^{\alpha+1}(x_k, W) = \frac{\partial F_k}{\partial \varphi_{kj}^{\alpha}(W)}$$

$$= \frac{\partial F_k}{\partial g_j^{\alpha+1}(x_k, W)} \frac{\partial g_j^{\alpha+1}(x_k, W)}{\partial \varphi_{kj}^{\alpha}(W)}$$

$$= \frac{\partial F_k}{\partial g_j^{\alpha+1}(x_k, W)} \frac{ds}{dt}(\varphi_{kj}^{\alpha}(W))$$

$$= \frac{\partial F_k}{\partial g_j^{\alpha+1}(x_k, W)} g_j^{\alpha+1}(x_k, W)(1 - g_j^{\alpha+1}(x_k, W))$$

$$= \frac{\partial F_k}{\partial g_j^{M}(x_k, W)} g_j^{M}(x_k, W)(1 - g_j^{M}(x_k, W)).$$

$$\text{But } F_k(W) = \sum_{l=1}^{M} (y_{kl} - g_l^{M}(x_k, W))^2,$$

$$\text{where } y_k = \begin{pmatrix} y_{k1} \\ \vdots \\ y_{km} \end{pmatrix} \in R^m.$$

$$\text{So } \frac{\partial F_k}{\partial g_j^{M}(x_k, W)} = -2(y_{kj} - g_j^{M}(x_k, W)).$$

$$\text{Thus } \delta_j^{M}(x_k, W) = -2(y_{kj} - g_j^{M}(x_k, W)) g_j^{M}(x_k, W)(1 - q_j^{M}(x_k, W)).$$

The foregoing analysis shows that the $\delta_j^\alpha$ can be computed using the following (back propagation) algorithm:

for each k≥1 for i=1 to m $$\delta_j^M(x_k, W) \leftarrow -2(y_{ki} - g_j^M(x_k, W))g_j^M(x_k, W)(1 - g_j^M(x_k, W))$$

for α=2 to M−1 for i=1 to $N_\alpha$ $$\delta_i^\alpha(x_k, W) \leftarrow (\Sigma_{j=1}^{N_{\alpha+1}} w_{ij}^\alpha \delta_j^{\alpha+1}(x_k, W))g_i^\alpha(x_k, W)(1 - g_i^\alpha(x_k, W))$$

For ∈{1, . . . , Q}, we have $$\begin{aligned}\frac{\partial F_k}{\partial W_q} &= \lim_{N\to\infty} \frac{1}{N}\sum_{k=1}^{N} \frac{\partial F_k}{\partial W_q} \\ &= \lim_{N\to\infty} \frac{1}{N}\sum_{k=1}^{N} \frac{\partial F_k}{\partial w_{ij}^\alpha} \\ &= \lim_{N\to\infty} \frac{1}{N}\sum_{k=1}^{N} \frac{\partial F_k}{\partial \varphi_{kj}^\alpha(W)} \frac{\partial \varphi_{kj}^\alpha(W)}{\partial w_{ij}^\alpha} \\ &= \lim_{N\to\infty} \frac{1}{N}\sum_{k=1}^{N} \delta_j^{\alpha+1}(x_k, W)g_i^\alpha(x_k, W),\end{aligned}$$

where α, i and j are understood to depend on q.

So, to move W in a direction that will decrease F, we only have to move in the direction $$-\nabla F(W) = -\left(\frac{\partial F}{\partial W_1}, \cdots, \frac{\partial F}{\partial W_O}\right),$$

where, for q ∈{1, . . . , Q}, $$\frac{\partial F}{\partial W_q} = \lim_{N\to\infty} \frac{1}{N}\sum_{k=1}^{N} \delta_j^{\alpha+1}(x_k, W)g_i^\alpha(x_k, W)$$

Thus a reasonable strategy for decreasing F is $$W \leftarrow W - \rho\nabla F(W)$$

For ρ a small positive constant (called the learning rate). Thus the rule for updating weights is $$w_{ij}^\alpha \leftarrow w_{ij}^\alpha - \rho \lim_{N\to\infty} \frac{1}{N}\sum_{k=1}^{N} \delta_j^{\alpha+1}(x_k, W)g_i^\alpha(x_k, W).$$

where, on the right hand side of the assignment, the weights and the weight vector W take their existing (non-updated) values.

In practice, we will be limited to a finite number N of training examples, where N is sufficiently large. In this setting, we would redefine F by $$F(W) \stackrel{df}{=} \frac{1}{N}\sum_{k=1}^{N} F_k(W)$$

and the rule for updating weights (assuming that the error is not already zero) becomes $$w_{ij}^\alpha \leftarrow w_{ij}^\alpha - \rho\frac{1}{N}\sum_{k=1}^{N} \delta_j^{\alpha+1}(x_k, W)g_i^\alpha(x_k, W)$$

If the error is still positive we can continue to update W by reapplying the same rule.

In this way, we get an iterative procedure for decreasing the error of the neural network's computed values relative to the training set $\{(x_1, y_1), \ldots, (x_N, y_N)\}$.

Appendix D—Algorithms—Core of Supervised Machine Learning Device

We will employ, without further mention, the same notation as used in the section The Mathematics of Back Propagation. As well as the weight vector W, we have a bias vector $$B = (\beta_j^\alpha)_{\substack{1\le\alpha\le M, \\ 1\le i\le N_\alpha}}$$

Where $\beta_i^\alpha$ is the bias term associated with the $i^{th}$ neuron of layer α.

The forward pass becomes for $i = 1$ to $n$ $g_i^1(X, W, B) \leftarrow X_i$ for $\alpha = 2$ to $M$ for $i = 1$ to $N_\alpha$ $$g_j^\alpha(X, W, B) \leftarrow s\left(\left(\sum_{l=1}^{N} w_{li}^{\alpha-1} g_l^{\alpha-1}(X, W, B)\right) + \beta_i^\alpha\right),$$

Where s(x) is the logistic function.

Then $$g(X, W, B) \stackrel{df}{=} \begin{pmatrix} g_1^M(X, W, B) \\ \vdots \\ g_m^M(X, W, B) \end{pmatrix} \in R^m$$

is the neural network's output function.

Let $\{(x_1, y_1), \ldots, (x_N, y_N)\}$ be the training set.

The back propagation algorithm becomes $$\text{for } k = 1 \text{ to } N$$

$$\left[\begin{array}{l} \text{for } i = 1 \text{ to } N \\ \delta_i^M \lfloor x_k, W, B \rfloor \leftarrow -2(y_{ki} - g_i^M(x_k, W, B))g_i^M(x_k, W, B)(1 - g_i^M(x_k, W, B)) \\ \text{for } \alpha = 2 \text{ to } M - 1 \\ \text{for } i = 1 \text{ to } N_\alpha \\ \delta_i^\alpha(x_k, W, B) \leftarrow \\ \left(\sum_{l=1}^{N_{\alpha+s}} w_{il}^\alpha \rho_l^{\alpha+1}(x_k, W, B)\right) g_i^\alpha(x_k, W, B)(1 - g_i^\alpha(x_k, W, B)) \end{array}\right.$$

The rule for updating weights becomes $$\text{for } \alpha = 1 \text{ to } M - 1$$

$$\text{for } i = 1 \text{ to } N_\alpha$$

$$\text{for } j = 1 \text{ to } N_{\alpha+1}$$

$$w_{ij}^\alpha \leftarrow w_{ij}^\alpha - \rho \frac{1}{N} \sum_{k=1}^{N} \delta_j^{\alpha+1}(x_k, W, B) g_i^\alpha(x_k, W, B).$$

The rule for updating biases becomes $$\text{for } \alpha = 1 \text{ to } M$$

$$\text{for } i = 1 \text{ to } N_\alpha$$

$$\beta_i^\alpha \leftarrow \beta_i^\alpha - \rho \frac{1}{N} \sum_{k=1}^{N} \rho_i^{\alpha+1}(x_k, W, B).$$

The learning rate ρ was set at 0.1.

The derivations of the above algorithms follow the same lines as the derivations given in the section The Mathematics of Back Propagation, where biases were not used. The derivations are available on request.

Appendix E—Algorithms to Provide Improvements in Speed and Accuracy of Training the Supervised Machine Learning Device (Neural Networks)

We have found that the convergence of the training algorithm as specified in the section The Mathematics of Back Propagation is too slow. As in that section, let F(W), for $$W \exists R^Q,$$

be the error function associated with some given training set $\{(x_1, y_1), \ldots, (x_N, y_N)\}$. As before, we will assume, for simplicity, that there are no biases. For each $q \in \{1, \ldots, Q\}$, $W_q$ is equal to some $w_{ij}^\alpha$ and then we have $$\frac{\partial F}{\partial W_q} = \frac{1}{N} \sum_{k=1}^{N} \delta_{k=1}^{\alpha+1}(x_k, W) g_i^\alpha(x_k, W),$$

where the $\delta_j^{\alpha+1}(x_k, W)$ are computed using the back propagation algorithm as explained earlier. Thus we can readily compute $$\nabla F(W) = \begin{pmatrix} \frac{\partial F}{\partial W_1} \\ \vdots \\ \frac{\partial F}{\partial W_Q} \end{pmatrix}$$

at any $W \in R^Q$.

We wish to define a sequence $W^{(n)}$ of iterates $W^{(n)} \in R^Q$ that converges to a local minimum of $$F: R^Q \rightarrow R$$

at a much faster rate than in the previously specified algorithm. The algorithm that we now proceed to outline, although not yet implemented, should supply the required iterates.

Suppose, for the moment, we are at the iterate $W^{(n)}$ and that F can be locally approximated at $W^{(n)}$ by a quadratic function $$F(W^n) + (W - W^{(n)})^T \nabla F(W^{(n)}) + \frac{1}{2} Q_{H^n}(W - W^{(n)}),$$

Where $Q_H^{(n)}$ is the quadratic form associated with the Hessian matrix $$H^{(n)} \stackrel{df}{=} \left( \frac{\partial^2 F}{\partial W_p \partial W_q} \middle| W^{(n)} \right)_{(n,o)}$$

At $W^{(n)}$ Note that $H^{(n)}$ is not known.

Now, for W close to $W^{(n)}$ we have $$\nabla F(W) \approx \nabla F(W^{(n)}) + H^{(n)}(W - W^{(n)}).$$

If we were using Newton's method (which is not applicable because it is not globally convergent), we would set ∇F(W) to be the zero vector and derive the Newton iterate W satisfying $$\nabla F(W^{(n)}) + H^{(n)}(W - W^{(n)}) = 0,$$

whence $W - W^{(n)} = -H^{(n)-s} \nabla F(W^{(n)})$.

We define $$d^{(n)} \stackrel{df}{=} -H^{(n)-s} \nabla F(W^{(n)}) = W - W^{(n)},$$

the Newton step from $W^{(n)}$.

If we can approximate $W^{(n)-1}$, we will get an approximation of the Newton step $d^{(n)}$ at $W^{(n)}$. So our aim is to approximate $H^{(n)-s}$, and we do this by constructing a sequence $(H_m)$ of symmetric positive definite matrices $H_m$ that converge to $H^{(n)-s}$.

Now, for $d^{(n)}$ to be a descent direction from $W^{(n)}$, that is, a direction in which F decreases, we must have $$(\nabla F(W^{(n)}))^T d^{(n)} = (-H^{(n)}(W - W^{(n)}))^T d^{(n)}$$
$$= -Q_{H^{(n)}}(d^{(n)}) < 0.$$

assuming that $d^{(n)} \neq 0$ and $H^{(n)}$ is symmetric and positive definite.

If $W^{(n)}$ is not close to a local minimum of F, $H^{(n)}$ may not be positive definite. So we use, not $H^{(n)}$, the Hessian matrix, but the approximating matrix $H_n^{-1}$, where $H_n$, is constructed to be symmetric and positive definite (and we rely on the fact that inverse of a symmetric and positive definite matrix is also symmetric and positive definite). Note that we have not yet shown how to construct the matrices $H_n$. Now, taking the full Newton step $d^{(n)}$ from $W^{(n)}$ may not decrease F, but F does initially decrease as we move in the direction $d^{(n)}$. So we can use a one-dimensional search to determine the maximum $\rho \in (0.1]$ for which $$F(W^{(n)} + \rho d^{(n)}) < F(W^{(n)}),$$

and we can then define $$\rho^{(n)} \stackrel{df}{=} \rho,$$
$$W^{(n+1)} \stackrel{df}{=} W^{(n)} + \rho^{(n)} d^{(n)} \text{ and}$$
$$\rho^{(n)} \stackrel{df}{=} \rho^{(n)} d^{(n)} = W^{(n+1)} - W^{(n)}.$$

So if $W^{(n)}$ is not close to a local minimum of F, the partial step $\delta^{(n)}$ still decreases F.

If $W^{(n)}$ is close to a local minimum of F, then, for n large enough, $H_n$ will approximate $H^{(n)-1}$ which will be symmetric and positive definite, so that, if F is quadratic, the full set will be taken, that is, $\delta^{(n)} = d^{(n)}$, and quadratic convergence will be achieved.

We now show how to construct the matrices $H_n$.

We define $H_1 = I_Q$, the Q by Q identity matrix.

Now suppose $n \geq 1$.

We first define $$\Delta^{(n)} \stackrel{df}{=} \nabla F(W^{(n+1)}) - \nabla F(W^{(n)}) \text{ and}$$
$$\alpha \otimes \beta \stackrel{df}{=} (\alpha_p \beta_q)_{(p,q)},$$

for $\alpha, \beta \in R^Q$ (as column vectors).

case $\delta^{(n)} \cdot \Delta^{(n)} = 0$.

We define $H_{n+1} = H_n$ case $\delta^{(n)} \cdot \Delta^{(n)} \neq 0$

Here we define $$u^{(n)} \stackrel{df}{=} \frac{\delta^{(n)}}{\delta^{(n)}, \Delta^{(n)}} - \frac{H_n \Delta^{(n)}}{Q_{H_n}(\Delta^{(n)})} \text{ and}$$

-continued $$H_{n+1} \stackrel{df}{=} H_n + \frac{\delta^{(n)} \otimes \delta^{(n)}}{\delta^{(n)}, \Delta^{(n)}} - \frac{(H_n \Delta^{(n)}) \otimes (H_n \Delta^{(n)})}{Q_{H_n}(\Delta^{(n)})} + Q_{H_n}(\Delta^{(n)})(u^{(n)} \otimes Q^{(n)}).$$

One can check that, for each n, $H_n$ is symmetric and positive definite and $$\delta^{(n)} = -H_{n+1} \Delta^{(n)}.$$

One can also show that if F is a quadratic form $Q_A$, then $H_n$ converges to $A^{-1}$ in Q steps. So the algorithm for finding a local minimum of F starting from some given point $W^1 \in R^Q$ is to continue calculating $H_n$ and $W^{(n)}$ as specified above, except that when constructing $W^{(n+1)}$ from $W^{(n)}$ we define $d^{(n)}$ to be $-H_n \nabla F(W^{(n)})$.

The terminating condition is $\nabla F(W^{(n)}) = 0$, at which point $W^{(n)}$ will be a local minimum of F.

Interpretation

Global optimization is a population-based stochastic optimization technique. In global optimization, there is a population of agents, called particles, that traverse the search space. We will let N be the population size. The objective function is specified as a function of the position vector in the search space, say $$f: R^M \rightarrow R$$

Each particle has an associated position vector and a velocity vector. We will let $P_i$ and $V_i$ be, respectively, the position and velocity vectors for particle i. The components of these vectors, belonging to $R^M$, are initially assigned random values. Each particle keeps track of its personal best solution (position and associated function value) visited so far. This personal best solution is called pbest. Let $pbestP_i$ be the position vector for the personal best solution for particle i. The optimizer also keeps track of the global best solution, that is, the best solution (position and associated function value) visited so far by any of the particles in the population. The global best solution is called gbest. Let $gbestP \in R^m$ the position vector of the global best solution.

At each iteration, the position of each particle is updated as a simple function of its current position and velocity for i=1 to N for j=1 to M $$(P_i) \leftarrow (P_i)_j + (V_i)_j \Delta t,$$

Where $\Delta t$ is a fixed constant representing the change in time.

At each iteration, the velocity of each particle is also updated (after the update of its position)

for i=1 to N for j=1 to M $$(V_i)_j \leftarrow (V_i)_j + \alpha \text{rand}((gbestP)_j - (P_i)_j) + \beta \text{rand}((pbestP_i)_j - (P_i)_j).$$

Where $\alpha$ and $\beta$ are fixed positive constants and each occurrence of rand is a random number generated in the interval [0,1]. The updating rule for velocities contains two random components, one depending on the distance of a particle's position vector from the position vector of its personal best solution and the other depending on its distance from the position vector of the global best solution.

For appropriate choices of the parameters $\alpha$, $\beta$, and $\Delta t$ particle optimization has been found to be a simple and effective nonlinear optimization technique comparable in power to genetic algorithms. It works for functions of discrete variables as well as for functions of continuous variables.

Interpretation

Bus

In the context of this document, the term "bus" and its derivatives, while being described in a preferred embodiment as being a communication bus subsystem for interconnecting various devices including by way of parallel connectivity such as Industry Standard Architecture (ISA), conventional Peripheral Component Interconnect (PCI) and the like or serial connectivity such as PCI Express (PCIe), Serial Advanced Technology Attachment (Serial ATA) and the like, should be construed broadly herein as any system for communicating data.

In Accordance with:

As described herein, 'in accordance with' may also mean 'as a function of' and is not necessarily limited to the integers specified in relation thereto.

Composite Items

As described herein, 'a computer implemented method' should not necessarily be inferred as being performed by a single computing device such that the steps of the method may be performed by more than one cooperating computing devices.

Similarly objects as used herein such as 'web server', 'server', 'client computing device', 'computer readable medium' and the like should not necessarily be construed as being a single object, and may be implemented as a two or more objects in cooperation, such as, for example, a web server being construed as two or more web servers in a server farm cooperating to achieve a desired goal or a computer readable medium being distributed in a composite manner, such as program code being provided on a compact disk activatable by a license key downloadable from a computer network.

Database:

In the context of this document, the term "database" and its derivatives may be used to describe a single database, a set of databases, a system of databases or the like. The system of databases may comprise a set of databases wherein the set of databases may be stored on a single implementation or span across multiple implementations. The term "database" is also not limited to refer to a certain database format rather may refer to any database format. For example, database formats may include MySQL, MySQLi, XML or the like.

Wireless:

The invention may be embodied using devices conforming to other network standards and for other applications, including, for example other WLAN standards and other wireless standards. Applications that can be accommodated include IEEE 802.11 wireless LANs and links, and wireless Ethernet.

In the context of this document, the term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. In the context of this document, the term "wired" and its derivatives may be used to describe circuits, devices, systems, methods, techniques, communications channels, etc., that may communicate data through the use of modulated electromagnetic radiation through a solid medium. The term does not imply that the associated devices are coupled by electrically conductive wires.

Processes:

Unless specifically stated otherwise, as apparent from the following discussions, it is appreciated that throughout the specification discussions utilizing terms such as "processing", "computing", "calculating", "determining", "analyzing" or the like, refer to the action and/or processes of a computer or computing system, or similar electronic computing device, that manipulate and/or transform data represented as physical, such as electronic, quantities into other data similarly represented as physical quantities.

Processor:

In a similar manner, the term "processor" may refer to any device or portion of a device that processes electronic data, e.g., from registers and/or memory to transform that electronic data into other electronic data that, e.g., may be stored in registers and/or memory. A "computer" or a "computing device" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. The processing system further may include a memory subsystem including main RAM and/or a static RAM, and/or ROM.

Computer-Readable Medium:

Furthermore, a computer-readable carrier medium may form, or be included in a computer program product. A computer program product can be stored on a computer usable carrier medium, the computer program product comprising a computer readable program means for causing a processor to perform a method as described herein.

Networked or Multiple Processors:

In alternative embodiments, the one or more processors operate as a standalone device or may be connected, e.g., networked to other processor(s), in a networked deployment, the one or more processors may operate in the capacity of a server or a client machine in server-client network environment, or as a peer machine in a peer-to-peer or distributed network environment. The one or more processors may form a web appliance, a network router, switch or bridge, or any machine capable of executing a set of instructions (sequential or otherwise) that specify actions to be taken by that machine.

Note that while some diagram(s) only show(s) a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Additional Embodiments

Thus, one embodiment of each of the methods described herein is in the form of a computer-readable carrier medium carrying a set of instructions, e.g., a computer program that are for execution on one or more processors. Thus, as will be appreciated by those skilled in the art, embodiments of the present invention may be embodied as a method, an apparatus such as a special purpose apparatus, an apparatus such as a data processing system, or a computer-readable carrier medium. The computer-readable carrier medium carries computer readable code including a set of instructions that when executed on one or more processors cause a processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

Carrier Medium:

The software may further be transmitted or received over a network via a network interface device. While the carrier medium is shown in an example embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media.

Implementation:

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Means for Carrying Out a Method or Function

Furthermore, some of the embodiments are described herein as a method or combination of elements of a method that can be implemented by a processor of a processor device, computer system, or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

Connected

Similarly, it is to be noticed that the term connected, when used in the claims, should not be interpreted as being limitative to direct connections only. Thus, the scope of the expression a device A connected to a device B should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Specific Details

In the description provided herein, numerous specific details are set forth. However, it is understood that embodiments of the invention may be practised without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the gaming machine industries.

The invention claimed is:

1. A system for automating the detecting of problem gambling behavior, the system comprising:

a player interface adapted for receiving biometric data from a player, wherein the player is either a profiled gambler or a gambler; and a neural network, wherein the neural network is trained during a training phase involving profiled gamblers during which the neural network is trained using:

the occurrence of predefined pay table payout gaming scenarios determined from in-game data obtained from the profiled gamblers; and a plurality of biometric variables recorded from the profiled gamblers via the player interface in response to each occurrence of the predefined pay table payout gaming scenarios, such that:

in use, neural network, so trained, is able to detect problem gambling behavior in gamblers using:

the occurrence of the predefined pay table payout gaming scenarios determined from in-game data obtained from gamblers; and the plurality of biometric variables recorded from the gamblers via the player interface in response to the occurrence of the predefined pay table payout gaming scenarios.

2. A system as claimed in claim 1, wherein the biometric data comprise at least one of:

electrocardiograph data representing a heart rate of the player;

conductivity data representing skin conductivity of the player;

pressure data representing pressure exerted by the player on the player interface; and image data representing at least one of facial expressions and gestures of the player.

3. A system as claimed in claim 1, further comprising an identification device, and wherein the system is further adapted to receive identification data from the identification device identifying the player.

4. A system as claimed in claim 1, further comprising a security device, and wherein the system is further adapted to receive authentication data from the security device authenticating the player.

5. A system as claimed in claim 4, wherein the system is further adapted for storing, using the security device, player profile data representing a profile of the player.

6. A system as claimed in claim 1, wherein, responsive to the system detecting problem gambling behavior, the system is further adapted to implement gambling limitations.

7. A system as claimed in claim 6, wherein the gambling limitations comprise at least one of:

maximum wager amount, including per period and per wager;

gambling period restriction; and gambling duration restriction limitations.

8. A system as claimed in claim 1, wherein the predefined pay table payout gaming scenarios are highest paying pay table symbol combinations.

9. A system as claimed in claim 8, wherein the neural network has input neurons comprising:

input neurons for the occurrence of each the predefined pay table payout gaming scenarios; and input neurons for a plurality of physiological responses recorded in response to the occurrence of the predefined pay table payout gaming scenarios; and an output neuron for an assessment of problem gambling.

10. A system as claimed in claim 9, further comprising one hidden layer of neurons between the input neurons and the output neuron.

11. A system as claimed in claim 10, wherein the number of neurons of the hidden layer exceeds the number of input neurons.

12. A system as claimed in claim 11, wherein the input neurons comprise 16 neurons and wherein the hidden neurons comprise greater than 19 neurons.

13. A system as claimed in claim 12, wherein the input neurons comprise 16 neurons and wherein the hidden neurons comprise 30 neurons.

* * * * *